United States Patent [19]
Kavesh et al.
[11] 4,413,110
[45] Nov. 1, 1983

[54] HIGH TENACITY, HIGH MODULUS POLYETHYLENE AND POLYPROPYLENE FIBERS AND INTERMEDIATES THEREFORE

[75] Inventors: Sheldon Kavesh, Whippany; Dusan C. Prevorsek, Morristown, both of N.J.

[73] Assignee: Allied Corporation, Morris Township, Morris County, N.J.

[21] Appl. No.: 359,019

[22] Filed: Mar. 19, 1982

Related U.S. Application Data

[63] Continuation-in-part of Ser. No. 259,266, Apr. 30, 1981, abandoned.

[51] Int. Cl.[3] ..... C08F 10/02; C08F 10/06; D01F 6/04; D01F 6/06

[52] U.S. Cl. ..... 526/348.1; 264/164; 264/205; 264/210.8; 524/108; 524/366; 524/462; 524/464; 524/583; 524/585; 526/351; 526/352

[58] Field of Search ..... 526/348.1, 351, 352

[56] References Cited

U.S. PATENT DOCUMENTS 4,137,394 1/1979 Meihuizen et al. ..... 528/502

FOREIGN PATENT DOCUMENTS 3004699 8/1980 Fed. Rep. of Germany .
2051667 1/1981 United Kingdom .

OTHER PUBLICATIONS

Smith et al., "Ultrahigh-Strength Polyethylene Filaments by Solution Spinning and Hot Drawing", *Polymer Bulletin,* vol. 1, pp. 733-736, (1979).
Cansfield et al., "The Preparation of Ultra-High Modulus Polypropylene Films and Fibres", *Polymer Eng. & Sci.,* vol. 16, No. 11, pp. 721-724, (1976).
Kalb & Pennings, "Hot Drawing of Porous High Molecular Weight Polyethylene", Polymer Bulletin, vol. 1, pp. 879-880, (1979).
Kalb & Pennings, "Maximum Strength and Drawing Mechanism of Hot Drawn High Molecular Weight Polyethylene", *J. Mat. Sci.,* vol. 15, pp. 2584-2590, (1980).
Imada et al., "Crystal Orientation and Some Properties of Solid-State Extrudate of Linear Polyethylene", *J. Mat. Sci.* 6, (1971), 537-546.
Smith et al., "Ultradrawing of High-Molecular-Weight Polyethylene Cast From Solution", *J. Pol. Sci.,* 19, 877-888, (1981).
Smith et al., "Ultrahigh-Strength Polyethylene Filaments . . . ", *Makromol. Chem.,* 180, 2983-2986, (1979).
Kalb et al., "Spinning of High Molecular Weight Polyethylene . . . ", *Polymer Bulletin* 1, 871-876, (1979).
Smith et al., "Ultra-High-Strength Polyethylene . . . ", *J. Mat. Sci.* 15, (1980), 505-514.
Kalb & Pennings, "Hot Drawing of Porous High Molecular Weight Polyethylene", Polymer 21, (1), 3-4, (1980).
Smook et al., "Influence of Spinning/Hot Drawing Conditions on the Tensile Strength of Porous High Molecular Weight Polyethylene", *Polymer Bulletin,* vol. 2, pp. 775-783, (1980).

*Primary Examiner*—Stanford M. Levin
*Attorney, Agent, or Firm*—Alan M. Doernberg; Gerhard H. Fuchs; Roy H. Massengill

[57] ABSTRACT

Solutions of ultrahigh molecular weight polymers such as polyethylene in a relatively non-volatile solvent are extruded through an aperture at constant concentration through the aperture and cooled to form a first gel of indefinite length. The first gels are extracted with a volatile solvent to form a second gel and the second gel is dried to form a low porosity xerogel. The first gel, second gel or xerogel, or a combination, are stretched. Among the products obtainable are polyethylene fibers of greater than 30 or even 40 g/denier tenacity and of modulus greater than 1000 or even 1600 or 2000 g/denier.

19 Claims, 7 Drawing Figures

140°C = STRETCH TEMP.
24 IV PE

4% GEL CONCENTRATION
24 IV

HIGH TENACITY, HIGH MODULUS POLYETHYLENE AND POLYPROPYLENE FIBERS AND INTERMEDIATES THEREFORE

DESCRIPTION

This is a continuation-in-part of Ser. No. 259,266, filed Apr. 30, 1981, now abandoned.

BACKGROUND OF THE INVENTION

The present invention relates to ultrahigh molecular weight polyethylene and polypropylene fibers having high tenacity, modulus and toughness values and a process for their production which includes a gel intermediate.

The preparation of high strength, high modulus polyethylene fibers by growth from dilute solution has been described by U.S. Pat. No. 4,137,394 to Meihuizen et al. (1979) and pending application Ser. No. 225,288 filed Jan. 15, 1981, now U.S. Pat. No. 4,356,138.

Alternative methods to the preparation of high strength fibers have been described in various recent publications of P. Smith, A. J. Pennings and their coworkers. German Off. No. 3004699 to Smith et al. (Aug. 21, 1980) describes a process in which polyethylene is first dissolves in a volatile solvent, the solution is spun and cooled to form a gel filament, and finally the gel filament is simultaneously stretched and dried to form the desired fiber.

UK Patent application GB No. 2,051,667 to P. Smith and P. J. Lemstra (Jan. 21, 1981) discloses a process in which a solution of the polymer is spun and the filaments are drawn at a stretch ratio which is related to the polymer molecular weight, at a drawing temperature such that at the draw ratio used the modulus of the filaments is at least 20 GPa. The application notes that to obtain the high modulus values required, drawing must be performed below the melting point of the polyethylene. The drawing temperature is in general at most 135° C.

Kalb and Pennings in Polymer Bulletin, vol. 1, pp. 879–80 (1979), J. Mat. Sci., vol. 15, 2584–90 (1980) and Smook et at. in Polymer Bull., vol. 2, pp. 775–83 (1980) describe a process in which the polyethylene is dissolved in a nonvolatile solvent (paraffin oil) and the solution is cooled to room temperature to form a gel. The gel is cut into pieces, fed to an extruder and spun into a gel filament. The gel filament is extracted with hexane to remove the paraffin oil, vacuum dried and the stretched to form the desired fiber.

In the process described by Smook et. al. and Kalb and Pennings, the filaments were non-uniform, were of high porosity and could not be stretched continuously to prepare fibers of indefinite length.

BRIEF DESCRIPTION OF THE INVENTION

The present invention includes a stretched polyethylene fiber of substantially indefinite length being of weight avarage molecular weight at least about 500,000 and having a tenacity of at least about 20 g/denier, a tensile modulus at least about 500 g/denier, a creep value no more than about 5% (when measured at 10% of breaking load for 50 days at 23° C.), a porosity less than about 10% and a melting temperature of at least about 147° C. measured at 10° C./minute heating rate by differential scanning calorimetry).

The present invention also includes a stretched polyethylene fiber of substantially indefinite length being of weight average molecular weight of at least about 1,000,000 and having a tensile modulus of at least about 1600 g/denier, a main melting point of at least about 147° C. (measured at 10° C./minute heating rate by differential scanning calorimetry) and an elongation-to-break of not more than 5%.

The present invention also includes a stretched polypropylene fiber of substantially indefinite length being of weight average molecular weight of at least about 750,000 and having a tenacity of at least about 8 g/denier, a tensile modulus of at least about 160 g/denier and a main melting temperature of at least about 168° C. (measured at 10° C./minute heating rate by differential scanning calorimetry)

The present invention also includes a polyolefin gel fiber of substantially indefinite length comprising between about 4 and about 20 weight % solid polyethylene of weight average molecular weight at least about 500,000 or solid polypropylene of weight average molecular weight at least about 750,000, and between about 80 and about 96 weight % of a swelling solvent miscible with high boiling hydrocarbon and having an atmospheric boiling point less than about 50° C.

The preferred method of preparing the novel polyethylene and polypropylene fibers of the present invention is via the novel polyolefin gel fiber of the invention and, more preferably, also via a novel xerogel fiber, by a process claimed in out copending, commonly assigned application Ser. No. 539,020, filed herewith.

DETAILED DESCRIPTION OF THE INVENTION

Figure 1:
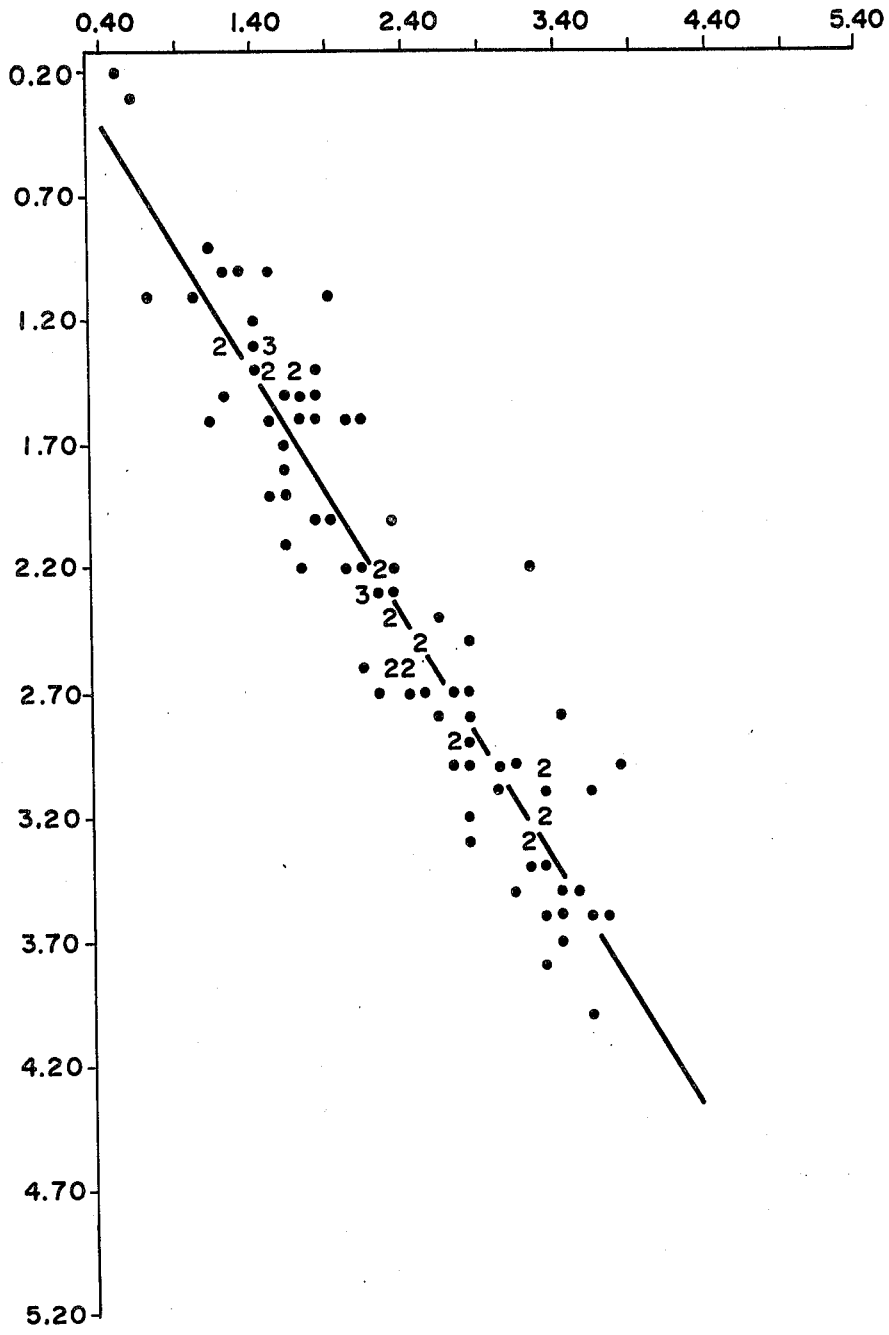
FIG. 1 is a graphic view of the tenacities of polyethylene fibers prepared according to Examples 3–99 of the present invention versus calculated values therefore as indicated in the Examples. The numbers indicate multiple points.

There are many applications which require a load bearing element of high strength, modulus, toughness, dimensional and hydrolytic stability and high resistance to creep under sustained loads.

For example, marine ropes and cables, such as the mooring lines used to secure supertankers to loading stations and the cables used to secure deep sea drilling platforms to underwater anchorage, are presently constructed of materials such as nylon, polyester, aramids and steel which are subject to hydrolytic or corrosive attack by sea water. In consequence such mooring lines and cables are construted with significant safety factors and are replaced frequently. The greatly increased weight and the need for frequent replacement create substantial operational and economic burdens.

The fibers and films of this invention are of high strength, extraordinarily high modulus and great toughness. They are dimensionally and hydrolytically stable and resistant to creep under sustained loads.

The fibers and films of the invention prepared according to the present process possess these properties in a heretofore unattained combination, and are therefore quite novel and useful materials.

Other applications for the fibers and films of this invention include reinforcements in thermoplastics, thermosetting resins, elastomers and concrete for uses such as pressure vessels, hoses, power transmission belts, sports and automotive equipment, and building construction.

In comparison to the prior art fibers perpared by Smith, Lemstra and Pennings described in Off No. 30 04 699, GB No. 205,1667 and other cited references, the strongest fibers of the present invention are of higher melting point, higher tenacity and much higher modulus. Additionally, they are more uniform, and less porous than the prior art fibers.

In comparison with Off No. 30 04 699 to Smith et. al. the process of the present invention has the advantage of greater controllability and reliability in that the steps of drying and stretching may be separate and each step may be carried out under otimal conditions. To illustrate, Smith & Lemstra in Polymer Bulletin, vol. 1, pp. 733–36 (1979) indicate that drawing temperature, below 143° C., had no effect on the relationships between either tenacity or modulus and stretch ratio. As will be seen, the properties of the fibers of the present invention may be controlled in part by varying stretch temperature with other factors held constant.

In comparison with the procedures described by Smook et. al in Polymer Bulletin, vol. 2, pp. 775–83 (1980) and in the above Kalb and Pennings articles, the process of the present invention has the advantage that the intermediate gel fibers which are spun are of uniform concentration and this concentration is the same as the polymer solution as prepared. The advantages of this unformity are illustrated by the fact that the fibers of the present invention may be stretched in a continuous operation to prepare packages of indefinite length. Additionally, the intermediate xerogel fibers of the present invention preferably contain less than about 10 volume % porosity compared to 23–65% porosity in the dry gel fibers described by Smook et. al. and Kalb and Pennings.

The crystallizable polymer used in the present invention may be polyethylene or polypropylene. In the case of polyethylene, suitable polymers have molecular weights (by intrinsic viscosity) in the range of about one to ten million. This corresponds to a weight average chain length of $3.6\times10^4$ to $3.6\times10^5$ monomer units or $7\times10^4$ to $7.1\times10^5$ carbons. Polypropylene should have similar backbone carbon chain lengths. The weight average molecular weight of polyethylene used is at least about 500,000 (6 IV), preferably at least about 1,000,000 (10 IV) and morre preferably between about 2,000,000 (16 IV) and about 8,000,000 (42 IV). The weight average molecular weight of polypropylene used is at least about 750,000 (5 IV), preferably at least about 1,000,000 (6 IV), more preferably at least about 1,500,000 (9 IV), and most preferably between about 2,000,000 (11 IV) and about 8,000,000 (33 IV). The IV numbers represent intrinsic visosity of the polymer in decalin at 135° C.

The first solvent should be non-volatile under the processing conditions. This is necessary in order to maintain essentially constant the concentration of solvent upstream and through the aperture (die) and to prevent non-uniformity in liquid content of the gel fiber or film containing first solvent. Preferably, the vapor pressure of the first solvent should be no more than about 20 kPa (about one-fifth of an atmosphere) at 175° C., or at the first temperature. Preferred first solvents for hydrocarbon polymers are aliphatic and aromatic hydrocarbons of the desired non-volatility and solubility for the polymer. The polymer may be present in the first solvent at a first concentration which is selected from a relatively narrow range, e.g. about 2 to 15 weight percent, preferably about 4 to 10 weight percent and more preferably about 5 to 8 weight percent; however, once chosen, the concentration should not vary adjacent the die or otherwise prior to cooling to the second temperature. The concentration should also remain reasonably constant over time (i.e. length of the fiber or film).

The first temperature is chosen to achieve complete dissolution of the polymer in the first solvent. The first temperature is the minimum temperature at any point between where the solution is formed and the die face, and must be greater than the gelation temperature for the polymer in the solvent at the first concentration. For polyethylene in paraffin oil at 5-15% concentration, the gelation temperature is approximately 100–130° C.; therefore, a preferred first temperature can be between 180° C. and 250° C., more preferably 200–240° C. While temperatures may vary above the first temperature at various points upstream of the die face, excessive temperatures causative of polymer degradation should be avoided. To assure complete solubility, a first temperature is chosen whereat the solubility of the polymer exceeds the first concentration, and is typically at least 100% greater. The second temperature is chosen whereas the solubility of the polymer is much less than the first concentration. Preferably, the solubility of the polymer in the first solvent at the second temperature is no more than 1% of the first concentration. Cooling of the extruded polymer solution from the first temperature to the second temperature should be accomplished at a rate sufficiently rapid to form a gel fiber which is of substantially the same polymer concentration as existed in the polymer solution. Preferably the rate at which the extruded polymer solution is cooled from the first temperature to the second temperature should be at least about 50° C. per minute.

Some stretching during cooling to the second temperature is not excluded from the present invention, but the total stretching during this stage should not normally exceed about 2:1, and preferably no more than about 1.5:1. As a result of those factors the gel fiber formed upon cooling to the second temperature consists of a continuous polymeric network highly swollen with solvent. The gel usually has regions of high and low polymer density on a microscopic level but is generally free of large (greater than 500 nm) regions void of solid polymer.

An aperture of circular cross section (or other cross section without a major axis in the plane perpendicular to the flow direction more than 8 times the smallest axis in the same plane, such as oval, Y- or X-shaped aperature) is used so that both gels will be gel fibers, the xerogel will be an xerogel fiber and the product will be a fiber. The diameter of the aperture is not critical, with representative aperatures being between about 0.25 mm and about 5 mm in diameter (or other major axis). The length of the aperture in the flow direction should normally be at least about 10 times the diameter of the aperture (or other similar major axis), perferably at least 15 times and more preferably at least 20 times the diameter (or other similar major axis).

The extraction with second solvent is conducted in a manner that replaces the first solvent in the gel with second solvent without significant changes in gel structure. Some swelling or shrinkage of the gel may occur, but preferably no substantial dissolution, coagulation or precipitation of the polymer occurs.

When the first solvent is a hydrocarbon, suitable second solvents include hydrocarbons, chlorinated hydrocarbons, chlorofluorinated hydrocarbons and others, such as pentane, hexane, heptane, toluene, methylene chloride, carbon tetrachloride, trichlorotrifluoroethane (TCTFE), diethyl ether and dioxane.

The most preferred second solvents are methylene chloride (B.P. 39.8° C.) and TCFE (B.P. 47.5° C.). Preferred second solvents are the non-flammable volatile solvents having an atmospheric boiling point below about 80° C., more preferably below about 70° C. and most preferably below about 50° C. Conditions of extraction should remove the first solvent to less than 1% of the total solvent in the gel.

A preferred combination of conditions is a first temperature between about 150° C. and about 250° C., a second temperature between about −40° C. and about 40° C. and a cooling rate between the first temperature and the second temperature at least about 50° C./minute. It is preferred that the first solvent be a hydrocarbon, when the polymer is a polyolefin such as ultrahigh molecular weight polyethylene. The first solvent should be substantially non-volatile, one measure of which is that its vapor pressure at the first temperature should be less than one-fifth atmosphere (20 kPa), and more preferably less than 2 kPa.

In choosing the fiirst and second solvents, the primary desired difference relates to volatility as discussed above. It is also preferred that the polymers be less soluble in the second solvent at 40° C. than in the first solvent at 150° C.

Once the gel containing second solvent is formed, it is then dried under conditions where the second solvent is removed leaving the solid network of polymer substantially intact. By analogy to silica gels, the resultant material is called herein a "xerogel" meaning a solid matrix corresponding to the solid matrix of a wet gel, with the liquid replaced by gas (e.g. by an inert gas such as nitrogen or by air). The term "xerogel" is not intended to delineate any particular type of surface area, porosity or pore size.

A comparison of the xerogel fibers of the present invention with corresponding dried gel fibers prepared according to prior art indicates the following major differences in structure: The dried xerogel fibers of the present invention preferably contain less than about ten volume percent pores compared to about 55 volume percent pores in the Kalb and Pennings dried gel fibers and about 23–65 volume percent pores in the Smook et al. dried gel fibers. The dried xerogel fibers of the present invention show a surface area (by the B.E.T. technique) of less than about 1 $m^2/g$ as compared to 28.8 $m^2/g$ in a fiber prepared by the prior art method (see Comparative Example 1 and Example 2, below).

The xerogel fibers of the present invention are also novel compared to dry, unstretched fibers of GB No. 2,051,667 and Off. 3004699 and related articles by Smith and Lemstra. This difference is evidenced by the deleterious effect of stretching below 75° C. or above 135° C. upon the Smith and Lemstra unstretched fibers. In comparison, stretching of the present xerogel fibers at room temperature and above 135° C. has beneficial rather than deleterious effects (see, for example, Examples 540–542, below). While the physical nature of these differences are not clear because of lack of information about Smith and Lemstra's unstretched fibers, it appears that one or more of the following characteristics of the present xerogel fibers must be lacking in Smith and Lemstra's unstretched fibers: (1) a crystalline orientation function less than 0.2, and preferably less than 0.1 as measured by wide angle X-ray diffraction; (2) microporosity less than 10% and preferrably less than 3%; (3) a crystallinity index as measured by wide angle X-ray diffraction (see P. H. Hermans and A. Weidinger, Macromol. Chem. vol. 44, p. 24 (1961)) less than 80% and preferably less than 75% (4) no detectable fraction of the triclinic crystalline form and (5) a fractional variation in spherulite size across a diameter of the fiber less than 0.25.

Stretching may be performed upon the gel fiber after cooling to the second temperature or during or after extraction. Alternatively, stretching of the xerogel fiber may be conducted, or a combination of gel stretch and xerogel stretch may be performed. The stretching may be conducted in a single stage or it may be conducted in two or more stages. The first stage stretching may be conducted at room temperatures or at an elevated temperature. Preferably the stretching is conducted in two or more stages with the last of the stages performed at a temperature between about 120° C. and 160° C. Most preferably the stretching is conducted in at least two stages with the last of the stages performed at a temperature between about 135° C. and 150° C. The Examples, and especially Examples 3–99 and 111–486, illustrate how the stretch ratios can be related to obtaining particular fiber properties.

The product polyethylene fibers produced by the present process represent novel articles in that they include fibers with a unique combination of properties: a tensile modulus at least about 500 g/denier (preferably at least about 1000 g/denier, more preferably at least about 1600 g/denier and most preferably at least about 2000 g/denier), a tenacity at least about 20 g/denier (preferably at least about 30 g/denier and more preferably at least about 40 g/denier), a main melting temperature (measured at 10° C./minute heating rate by differential scanning calorimetry) of at least about 147° C. (preferably at least about 149° C.), a porosity of no more than about 10% (preferably no more than about 6% and more preferably no more than about 3%) and a creep value no more than about 5% (preferably no more than about 3%) when measured at 10% of breaking load for 50 days at 23° C. Preferably the fiber has an elongation to break at most about 7,% and more preferably not more than about 5% (which correlates with the preferred tensile modulus of at least about 1000 g/denier). In addition, the fibers have high toughness and uniformity. Furthermore, as indicated in Examples 3–99 and 111–489 below, trade-offs between various properties can be made in a controlled fashion with the present process.

The novel polypropylene fibers of the present invention also include a unique combination of properties, previously unachieved for polypropylene fibers: a tenacity of at least about 8 g/denier (preferably at least about 11 g/denier and more preferably at least about 13 g/denier), a tensile modulus at least about 160 g/denier (preferably at least about 200 g/denier and more preferably at least about 220 g/denier), a main melting temperature (measured at 10° C./minute heating rate by differential scanning calorimetry) at least about 168° C. (preferably at least about 170° C.) and a porosity less about 10% (preferably no more than about 5%). Preferably, the polypropylene fibers also have an elongation to break less than about 20%.

Additionally a novel class of fibers of the invention are polypropylene fibers possessing a modulus of at least about 220 g/denier, preferably at least about 250 g/denier.

The gel fibers containing first solvent, gel fibers containing second solvent and xerogel fibers of the present invention also represent novel articles of manufacture, distinguished from somewhat similar products described by Smook et al. and by Kalb and Pennings in having a volume porosities of 10% or less compared to values of 23%-65% in the references.

In particular the second gel fibers differ from the comparable prior art materials in having a solvent with an atmospheric boiling point less than about 50° C. As indicated by Examples 100-108, below, the uniformity and cylindrical shape of the xerogel fibers improved progressively as the boiling point of the second solvent declined. As also indicated in Examples 100-108 (see Table III), substantially higher tenacity fibers were produced under equivalent drying and stretching conditions by using trichlorotrifluoroethane (boiling point 47.5° C.) as the second solvent compared to fibers produced by using hexane (boiling point 68.7° C.) as second solvent. The improvement in final fiber is then directly attributable to changes in the second solvent in the second gel fiber. Preferred such second solvents are halogenated hydrocarbons of the proper boiling point such as methylene chloride (dichloromethane) and trichlorotrifluoroethane, with the latter being most preferred.

DESCRIPTION OF THE PREFERRED EMBODIMENT

Figure 5:
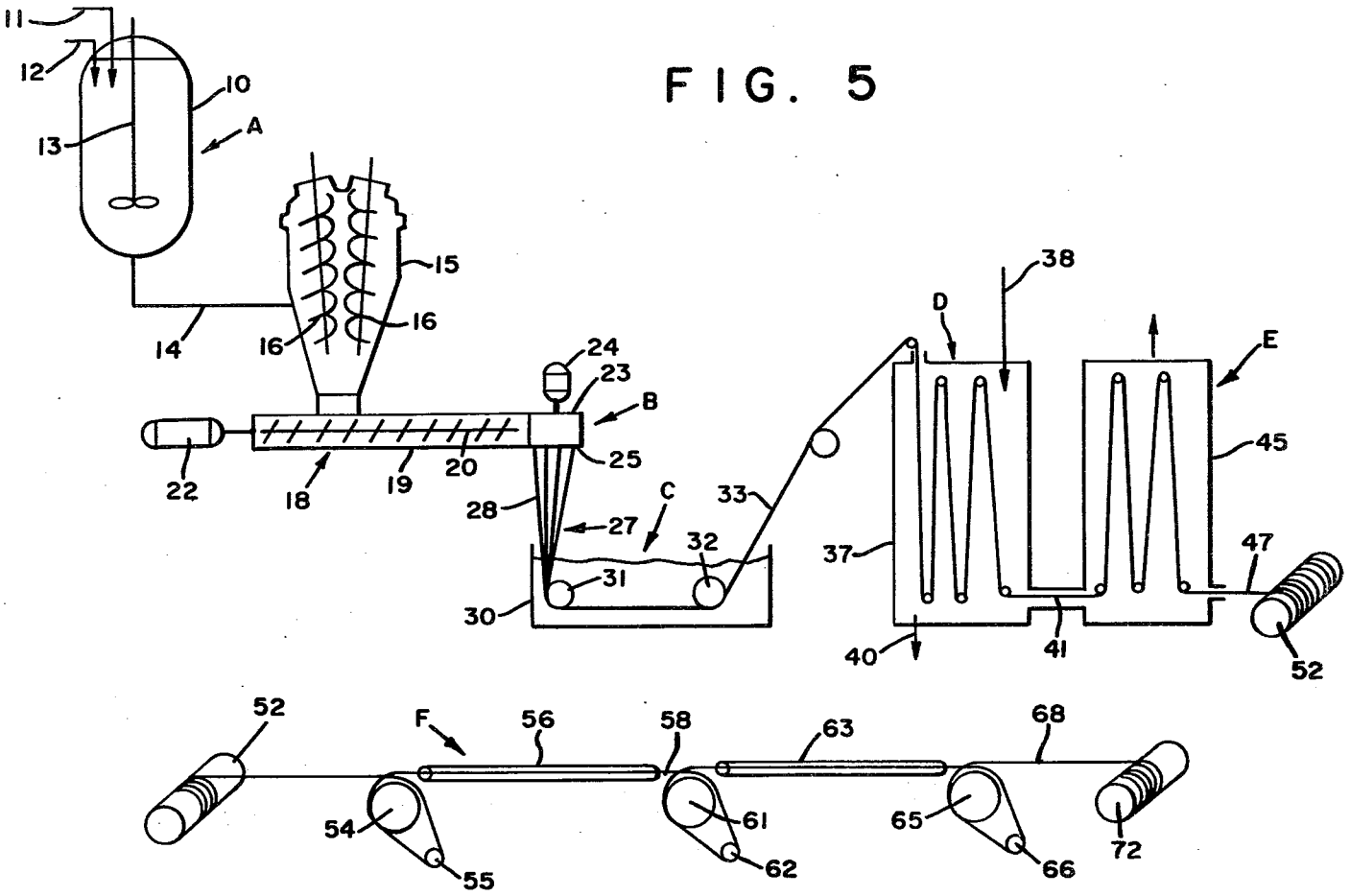
FIG. 5 is a schematic view of a first process used to prepare the products of the present invention.

FIG. 5 illustrates in schematic form a first process to produce the novel fibers, wherein the stretching step F is conducted in two stages on the novel xerogel fiber subsequent to drying step E. In FIG. 5, a first mixing vessel 10 is shown, which is fed with an ultra high molecular weight polymer 11 such as polyethylene of weight average molecular weight at least 500,000 and preferably at least 1,000,000, and to which is also fed a first, relatively non-volatile solvent 12 such as paraffin oil. First mixing vessel 10 is equipped with an agitator 13. The residence time of polymer and first solvent in first mixing vessel 10 is sufficient to form a slurry containing some dissolved polymer and some relatively finely divided polymer particles, which slurry is removed in line 14 to an intensive mixing vessel 15. Intensive mixing vessel 15 is equipped with helical agitator blades 16. The residence time and agitator speed in intensive mixing vessel 15 is sufficient to convert the slurry into a solution. It will be appreciated that the temperature in intensive mixing vessel 15, either because of external heating, heating of the slurry 14, heat generated by the intensive mixing, or a combination of the above is sufficiently high (e.g. 200° C.) to permit the polymer to be completely dissolved in the solvent at the desired concentration (generally between about 6 and about 10 percent polymer, by weight of solution). From the intensive mixing vessel 15, the solution is fed to an extrusion device 18, containing a barrel 19 within which is a screw 20 operated by motor 22 to deliver polymer solution at reasonably high pressure to a gear pump and housing 23 at a controlled flow rate. A motor 24 is provided to drive gear pump 23 and extrude the polymer solution, still hot, through a spinnerette 25 comprising a plurality of apertures, which may be circular, X-shaped, or, oval-shaped, or in any of a variety of shapes having a relatively small major axis in the plane of the spinnerette when it is desired to form fibers, and having a rectangular or other shape with an extended major axis in the plane of the spinnerette when it is desired to form films. The temperature of the solution in the mixing vessel 15, in the extrusion device 18 and a t the spinnerette 25 should all equal or exceed a first temperature (e.g. 200° C.) chosen to exceed the gellation temperature (approximately 100-130 C. for polyethylene in paraffin oil). The temperature may vary (e.g. 220° C., 210° C. and 200° C.) or may be constant (e.g. 220° C.) from the mixing vessel 15 to extrusion device 18 to the spinnerette 25. At all points, however, the concentration of polymer in the solution should be substantially the same. The number of apertures, and thus the number of fibers formed, is not critical, with convenient number of apertures being 16, 120, or 240.

From the spinnerette 25, the polymer solution passes through an air gap 27, optionally enclosed and filled with an inert gas such as nitrogen, and optionally provided with a flow of gas to facilitate cooling. A plurality of gel fibers 28 containing first solvent pass through the air gap 27 and into a quench bath 30, so as to cool the fibers, both in the air gap 27 and in the quench bath 30, to a second temperature at which the solubility of the polymer in the first solvent is relatively low, such that most of the polymer precipitates as a gel material. While some stretching in the air gap 27 is permissible, it is preferably less than about 2:1, and is more preferably much lower. Substantial stretching of the hot gel fibers in air gap 27 is believed highly detrimental to the properties of the ultimate fibers.

It is preferred that the quench liquid in quench bath 30 be water. While the second solvent may be used as the quench fluid (and quench bath 30 may even be integral with solvent extraction device 37 described below), it has been found in limited testing that such a modification impairs fiber properties.

Rollers 31 and 32 in the quench bath 30 operate to feed the fiber through the quench bath, and preferably operate with little or no stretch. In the event that some stretching does occur across rollers 31 and 32, some first solvent exudes out of the fibers and can be collected as a to layer in quench bath 30.

From the quench bath 30, the cool first gel fibers 33 pass to a solvent extraction device 37 where a second solvent, being of relatively low boiling such as trichlorotrfluoroethane, is fed in through line 38. The solvent outflow in line 40 contains second solvent and essentially all of tthe first solvent brought it with the cool gel fibers 33, either dissolved or dispersed in the second solvent. Thus the second gel fibers 41 conducted out of the solvent extraction device 37 contain substantially only second solvent, and relatively little first solvent. The second gel fibers 41 may have shrunken somewhat compared to the first gel fibers 33, but otherwise contain substantially the same polymer morphology.

In a drying device 45, the second solvent is evaporated from the second gel fibers 41 forming essentially unstretched xerogel fibers 47 which are taken up on spool 52.

From spool 52, or from a plurality of such spools if it is desired to operate the stretching line at a slower feed rate than the take up of spool 52 permits, the fibers are fed over driven fed roll 54 and idler roll 55 into a first heated tube 56, which may be rectangular, cylindrical or other convenient shape. Sufficient heat is applied to the tube 56 to cause the internal temperature to be between about 120 and 140° C. The fibers are stretched at a relatively high draw ratio (e.g. 10:1) so as to form partially stretched fibers 58 taken up by driven roll 61 and idler roll 62. From rolls 61 and 62, the fibers are taken through a second heated tube 63, heated so as to be at somewhat higher temperature, e.g. 130–160° C. and are then taken up by driven take-up roll 65 and idler roll 66, operating at a speed suficient to impart a stretch ratio in heated tube 63 as desired, e.g. about 2.5:1. The twice stretched fibers 68 produced in this first embodiment are taken up on take-up spool 72.

With reference to the six process steps of the process, it can be seen that the solution forming step A is conducted in mixers 13 and 15. The extruding step B is conducted with device 18 and 23, and especially through spinnerette 25. The cooling step C is conducted in airgap 27 and quench bath 30. Extraction step D is conducted in solvent extraction device 37. The drying step E is conducted in drying device 45. The stretching step F is conducted in elements 52–72, and especially in heated tubes 56 and 63. It will be appreciated, howrever, that various other parts of the system may also perform some stretching, even at temperatures substantially below thase of heated tubes 56 and 63. Thus, for example, some stretching (e.g. 2:1) may occur within quench bath 30, within solvent extraction device 37, within drying device 45 or between solvent extraction device 37 and drying device 45.

Figure 6:
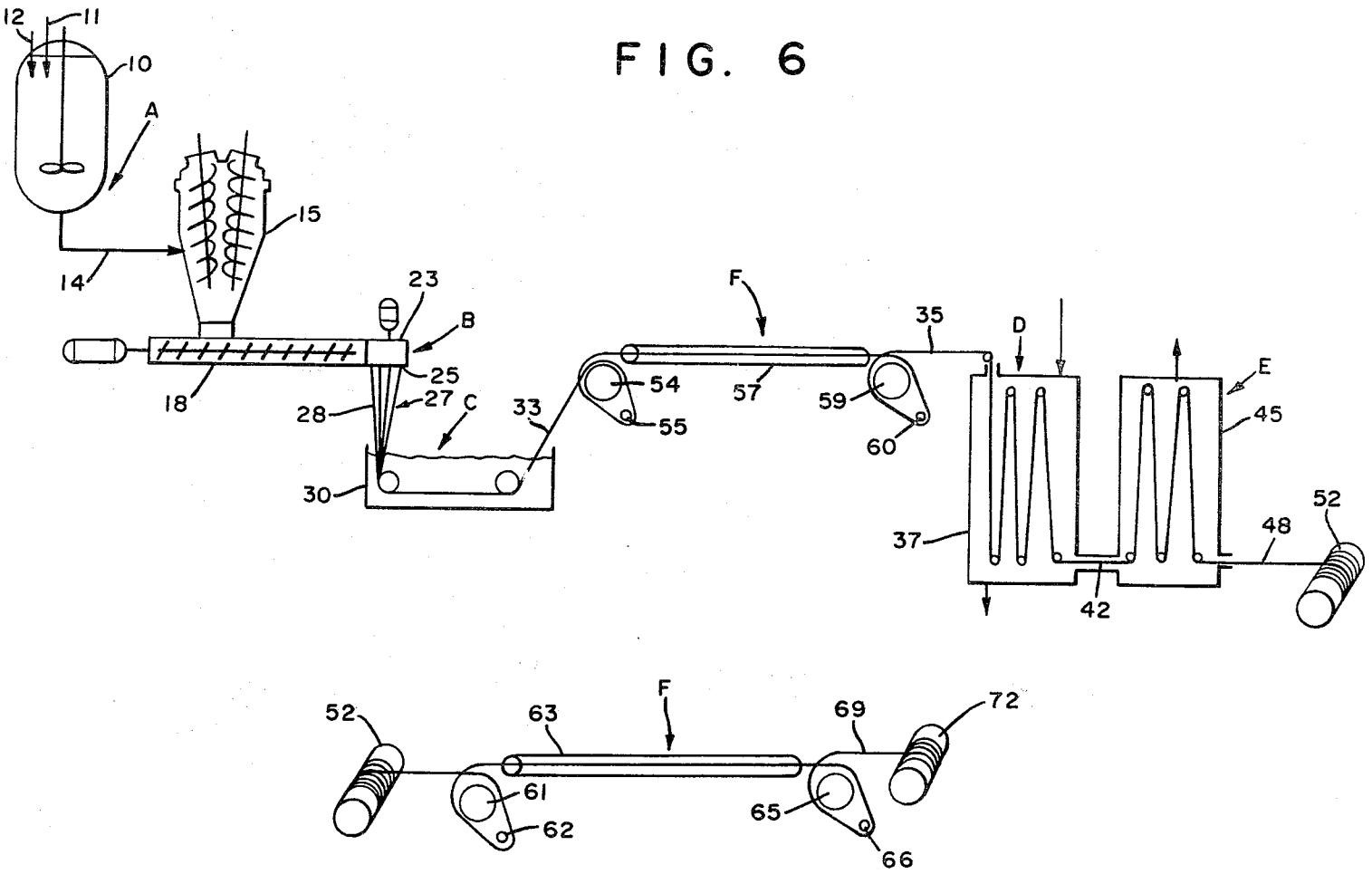
FIG. 6 is a schematic view of a second process used to prepare the products of the present invention.

A second process to produce the novel fiber products is illustrated in schematic form by FIG. 6. The solution forming and extruding steps A and B of the second embodiment are substantially the same as those in the first embodiment illustrated in FIG. 5. Thus, polymer and first solvent are mixed in first mixing vessel 10 and conducted as a slurry in line 14 to intensive mixing device 15 operative to form a hot solution of polymer in first solvent. Extrusion device 18 impells the solution under pressure through the gear pump and housing 23 and then through a plurality of apperatures in spinnerette 27. The hot first gel fibers 28 pass through air gap 27 and quench bath 30 so as to form cool first gel fibers 33.

The cool first gel fibers 33 are conducted over driven roll 54 and idler roll 55 through a heated tube 57 which, in general, is longer than the first heated tube 56 illustrated in FIG. 5. The length of heated tube 57 compensates, in general, for the higher velocity of fibers 33 in the second embodiment of FIG. 6 compared to the velocity of xerogel fibers (47) between take-up spool 52 and heated tube 56 in the first embodiment of FIG. 5. The fibers 33 are drawn through heated tube 57 by driven take-up roll 59 and idler roll 60, so as to cause a relatively high stretch ratio (e.g. 10:1). The once-stretched first gel fibers 35 are conducted into extraction device 37.

In the extraction device 37, the first solvent is extracted out of the gel fibers by second solvent and the novel gel fibers 42 containing second solvent are conducted to a drying device 45. There the second solvent is evaporated from the gel fibers; and novel xerogel fibers 48, being once-stretched, are taken up on spool 52.

Fibers on spool 52 are then taken up by driven feed roll 61 and idler 62 and passed through a heated tube 63, operating at the relatively high temperature of between about 130° and 160° C. The fibers are taken up by driven take up roll 65 and idler roll 66 operating at a speed sufficient to impart a stretch in heated tube 63 as desired, e.g. about 2.5:1. The twice-stretched fibers 69 produced in the second embodiment are then taken up on spool 72.

It will be appreciated that, by comparing the embodiment of FIG. 6 with the embodiment of FIG. 5, the stretching step F has been divided into two parts, with the first part conducted in heated tube 57 performed on the first gel fibers 33 prior to extraction (D) and drying (E), and the second part conducted in heated tube 63, being conducted on xerogel fibers 48 subsequent to drying (E).

Figure 7:
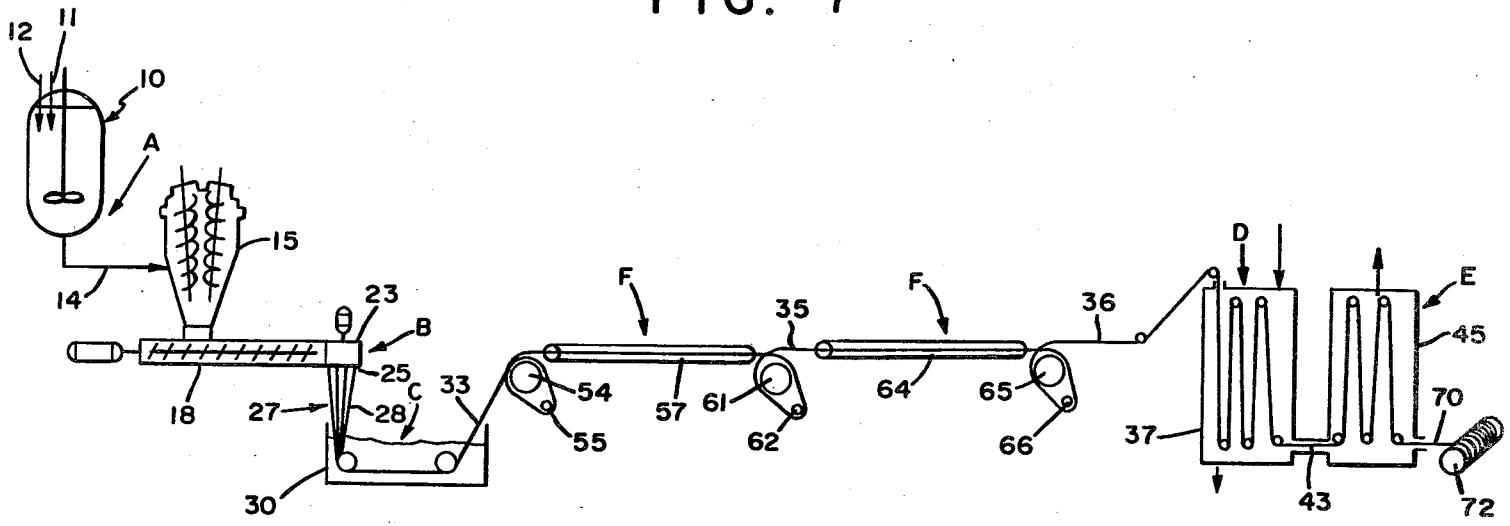
FIG. 7 is a schematic view of a third process used to prepare th products of the present invention.

A third process to produce novel fiber products is illustrated in FIG. 7, with the solution forming step A, extrusion step B, and cooling step C being substantially identical to the first embodiment of FIG. 5 and the second embodiment of FIG. 6. Thus, polymer and first solvent are mixed in first mixing vessel 10 and conducted as a slurry in line 14 to intensive mixing device 15 operative to form a hot solution of polymer in first solvent. Extrusion device 18 impells the solution under pressure through the gear pump and housing 23 and then through a plurality of apperatures in spinnerette 27. The hot first gel fibers 28 pass through air gap 27 and quench bath 30 so as to form cool first gel fibers 33.

The cool first gel fibers 33 are conducted over driven roll 54 and idler roll 55 through a heated tube 57 which, in general, is longer than the first heated tube 56 illustrated in FIG. 5. The length of heated tube 57 compensates, in general, for the higher velocity of fibers 33 in the third embodiment of FIG. 7 compared to the velocity of xerogel fibers (47) between takeup spool 52 and heated tube 56 in the first embodiment of FIG. 5. The first gel fibers 33 are now taken up by driven roll 61 and idler roll 62, operative to cause the stretch ratio in heated tube 57 to be as desired, e.g. 10:1.

From rolls 61 and 62, the once-drawn first gel fibers 35 are conducted into modified heated tube 64 and drawn by driven take up roll 65 and idler roll 66. Driven roll 65 is operated sufficiently fast to draw the fibers in heated tube 64 at the desired stretch ratio, e.g. 2.5:1. Because of the relatively high line speed in heated tube 64, required generally to match the speed of once-drawn gel fibers 35 coming off of rolls 61 and 62, heated tube 64 in the third embodiment of FIG. 7 will, in general, be longer than heated tube 63 in either the second embodiment of FIG. 6 or the first embodiment of FIG. 5. While first solvent may exude from the fiber during stretching in heated tubes 57 and 64 (and be collected at the exit of each tube), the first solvent is sufficiently non-volatile so as not to evaporate to an appreciable extent in either of these heated tubes.

The twice-stretched first gel fiber 36 is then conducted through solvent extraction device 37, where the second, volatile solvent extracts the first solvent out of the fibers. The second gel fibers, containing substantially only second solvent, is then dried in drying device 45, and the twice-stretched fibers 70 are then taken up on spool 72.

It will be appreciated that, by comparing the third embodiment of FIG. 7 to the first two embodiments of FIGS. 5 and 6, the stretching step (F) is performed in the third embodiment in two stages, both subsequent to cooling step C and prior to solvent extracting step D.

The invention will be further illustrated by the examples below. The first example illustrates the prior art techniques of Smook et. al. and the Kalb and Pennings articles.

COMPARATIVE EXAMPLE 1

A glass vessel equipped with a PTFE paddle stirrer was charged with 5.0 wt% linear polyethylene (sold as Hercules UHMW 1900, having 24 IV and approximately $4\times10^6$ M.W.), 94.5 wt% paraffin oil (J. T. Baker, 345–355 Saybolt viscosity) and 0.5 wt% antioxidant (sold under the trademark Ionol).

The vessel was sealed under nitrogen pressure and heated with stirring to 150° C. The vessel and its contents were maintained under slow agitation for 48 hours. At the end of this period the solution was cooled to room temperature. The cooled solution separated into two phases-A "mushy" liquid phase consisting of 0.43 wt% polyethylene and a rubbery gel phase consisting of 8.7 wt% polyethylene. The gel phase was collected, cut into pieces and fed into a 2.5 cm (one inch) Sterling extruder equipped with a 21/1 L/D polyethylene-type screw. The extruder was operated at 10 RPM, 170° C. and was equipped with a conical single hole spinning die of 1 cm inlet diameter, 1 mm exit diameter and 6 cm length.

The deformation and compression of the gel by the extruder screw caused exudation of paraffin oil from the gel. This liquid backed up in the extruder barrel and was mostly discharged from the hopper end of the extruder. At the exit end of the extruder a gel fiber of approximately 0.7 mm diameter was collected at the rate of 1.6 m/min. The gel fiber consisted of 24–38 wt% polyethylene. The solids content of the gel fiber varied substantially with time.

The paraffin oil was extracted from the extruded gel fiber using hexane and the fiber was dried under vacuum at 50° C. The dried gel fiber had a density of 0.326 g/cm$^3$. Therefore, based on a density of 0.960 for the polyethylene constituent, the gel fiber consisted of 73.2 volume percent voids. Measurement of pore volume using a mercury porosimeter showed a pore volume of 2.58 cm$^3$/g. A B.E.T. measurement of surface area gave a value of 28.8 m$^2$/g.

The dried fiber was stretched in a nitrogen atmosphere within a hot tube of 1.5 meters length. Fiber feed speed was 2 cm/min. Tube temperature was 100° C. at the inlet increasing to 150° C. at the outlet.

It was found that, because of filament nonuniformity, stretch ratios exceeding 30/1 were not sustainable for periods exceeding about 20 minutes without filament breakage.

The properties of the fiber prepared at 30/1 stretch ratio were as follows:

denier—99
tenacity—23 g/d
modulus—980 g/d
elongation at break—3%
work-to-break—6570 in lbs./in$^3$ (45 MJ/m$^3$)

The following example is illustrative of the present invention:

EXAMPLE 2

An oil jacketed double helical (Helicone®) mixer constructed by Atlantic Research Corporation was charged with 5.0 wt% linear polyethylene (Hercules UHMW 1900 having a 17 IV and approximately $2.5\times10^6$ M.W.) and 94.5 wt% paraffin oil (J. T. Baker, 345–355 Saybolt viscosity). The charge was heated with agitation at 20 rpm to 200° C. under nitrogen pressure over a period of two hours. After reaching 200° C., agitation was maintained for an additional two hours.

The bottom discharge opening of the Helicone mixer was fitted with a single hole capillary spinning die of 2 mm diameter and 9.5 mm length. The temperature of the spinning die was maintained at 200° C.

Nitrogen pressure applied to the mixer and rotation of the blades of the mixer were used to extrude the charge through the spinning die. The extruded uniform solution filament was quenched to a gel state by passage through a water bath located at a distance of 33 cm (13 inches) below the spinning die. The gel filament was wound up continuously on a 15.2 cm (6 inch) diameter bobbin at the rate of 4.5 meters/min.

The bobbins of gel fiber were immersed in trichlorotrifloroethane (fluorocarbon 113 or "TCTFE") to exchange this solvent for paraffin oil as the liquid constituent of the gel. The gel fiber was unwound from a bobbin, and the fluorocarbon solvent evaporated at 22°–50° C.

The dried fiber was of 970±100 denier. The density of the fiber was determined to be 950 kg/m$^3$ by the density gradient method. Therefore, based on a density of 960 kg/m$^3$ for the polyethylene constituent, the dried fiber contained one volume percent voids. A B.E.T. measurement of the surface area gave a value less than 1 m$^2$/g.

The dried gel fiber was fed at 2 cm/min into a hot tube blanketed with nitrogen and maintained at 100° C. at its inlet and 140° C. at its outlet. The fiber was stretched continously 45/1 within the hot tube for a period of three hours without experiencing fiber breakage. The properties of the stretched fiber were:

denier—22.5
tenacity—37.6 g/d
modulus—1460 g/d
elongation—4.1%
work-to-break—12,900 in-lbs/in$^3$ (89 MJ/m$^3$)

EXAMPLES 3–99

A series of fiber samples was prepared following the procedures described in Example 2, but with variations introduced in the following material and process parameters:

a. polyethylene IV (molecular weight)
b. polymer gel concentration
c. stretch temperature
d. fiber denier
e. stretch ratio The results of these experiments upon the final fiber properties obtained are presented in Table I. The Polymer intrinsic viscosity values were 24 in Examples 3–49 and 17 in Examples 50–99. The gel concentration was 2% in Examples 26–41, 4% in Examples 3–17, 5% in Examples 42–99 and 6% in Examples 18–25.

TABLE I

| Ex. | Stretch Temp., °C. | Stretch Ratio | Denier | Tenacity g/d | Modulus g/d | Elong % |
|---|---|---|---|---|---|---|
| 3 | 142 | 15.6 | 2.8 | 17.8 | 455. | 6.7 |
| 4 | 145 | 15.5 | 2.8 | 18.6 | 480. | 6.7 |
| 5 | 145 | 19.6 | 2.2 | 19.8 | 610. | 5.2 |
| 6 | 145 | 13.0 | 3.4 | 13.7 | 350. | 6.2 |
| 7 | 145 | 16.6 | 2.7 | 15.2 | 430. | 5.7 |
| 8 | 144 | 23.9 | 1.8 | 23.2 | 730. | 4.9 |
| 9 | 150 | 16.0 | 2.7 | 14.6 | 420. | 5.0 |
| 10 | 150 | 27.3 | 1.6 | 21.6 | 840. | 4.0 |
| 11 | 149 | 23.8 | 1.8 | 21.8 | 680. | 4.6 |
| 12 | 150 | 27.8 | 1.6 | 22.6 | 730. | 4.3 |
| 13 | 140 | 14.2 | 3.1 | 16.5 | 440. | 5.3 |
| 14 | 140 | 22.0 | 2.0 | 21.7 | 640. | 4.7 |
| 15 | 140 | 25.7 | 1.7 | 26.1 | 810. | 4.7 |
| 16 | 140 | 3.4 | 5.6 | 11.2 | 224. | 18.0 |
| 17 | 140 | 14.9 | 2.9 | 20.8 | 600. | 5.6 |
| 18 | 145 | 19.5 | 11.7 | 16.4 | 480. | 6.3 |
| 19 | 145 | 11.7 | 19.4 | 16.3 | 430. | 6.1 |
| 20 | 145 | 22.3 | 10.2 | 24.1 | 660. | 5.7 |
| 21 | 145 | 47.4 | 4.8 | 35.2 | 1230. | 4.3 |
| 22 | 150 | 15.1 | 15.0 | 14.0 | 397. | 6.5 |
| 23 | 150 | 56.4 | 4.0 | 28.2 | 830. | 4.4 |
| 24 | 150 | 52.8 | 4.3 | 36.3 | 1090 | 4.5 |
| 25 | 150 | 12.8 | 17.8 | 19.1 | 440. | 7.2 |
| 26 | 143 | 10.3 | 21.4 | 8.7 | 178. | 7.0 |
| 27 | 146 | 1.8 | 120.0 | 2.1 | 22. | 59.7 |
| 28 | 146 | 3.2 | 69.5 | 2.7 | 37. | 40.5 |
| 29 | 145 | 28.0 | 7.9 | 16.0 | 542. | 4.9 |
| 30 | 145 | 50.2 | 4.4 | 21.6 | 725. | 4.0 |
| 31 | 145 | 30.7 | 7.2 | 22.7 | 812. | 4.2 |
| 32 | 145 | 10.2 | 21.8 | 16.2 | 577. | 5.6 |
| 33 | 145 | 22.3 | 9.9 | 15.3 | 763. | 2.8 |
| 34 | 150 | 28.7 | 7.7 | 10.5 | 230. | 8.4 |
| 35 | 150 | 12.1 | 18.3 | 12.6 | 332. | 5.2 |
| 36 | 150 | 8.7 | 25.5 | 10.9 | 308. | 5.9 |
| 37 | 150 | 17.4 | 12.7 | 14.1 | 471. | 4.6 |
| 38 | 140 | 12.0 | 18.5 | 12.7 | 357. | 7.3 |
| 39 | 140 | 21.5 | 10.3 | 16.1 | 619. | 4.2 |
| 40 | 140 | 36.8 | 6.0 | 23.8 | 875. | 4.1 |
| 41 | 140 | 59.7 | 3.7 | 26.2 | 1031. | 3.6 |
| 42 | 145 | 13.4 | 25.0 | 12.9 | 344. | 8.3 |
| 43 | 145 | 24.4 | 13.7 | 22.3 | 669. | 5.9 |
| 44 | 145 | 25.2 | 13.3 | 23.2 | 792. | 4.9 |
| 45 | 145 | 33.5 | 10.0 | 29.5 | 1005. | 4.9 |
| 46 | 150 | 17.2 | 19.5 | 14.2 | 396. | 5.6 |
| 47 | 150 | 16.0 | 21.0 | 15.7 | 417. | 7.2 |
| 48 | 140 | 11.2 | 30.0 | 13.1 | 316. | 8.3 |
| 49 | 140 | 21.0 | 16.0 | 23.0 | 608. | 6.0 |
| 50 | 130 | 15.8 | 64.9 | 14.2 | 366. | 6.0 |
| 51 | 130 | 44.5 | 23.1 | 30.8 | 1122. | 4.4 |
| 52 | 130 | 24.3 | 42.4 | 26.8 | 880. | 4.7 |
| 53 | 130 | 26.5 | 38.8 | 23.6 | 811. | 4.2 |
| 54 | 140 | 11.0 | 93.3 | 14.5 | 303. | 8.4 |
| 55 | 140 | 28.3 | 36.3 | 24.7 | 695. | 4.8 |
| 56 | 140 | 43.4 | 23.7 | 30.3 | 905. | 4.8 |
| 57 | 140 | 18.4 | 55.9 | 19.7 | 422. | 6.6 |
| 58 | 150 | 15.7 | 65.5 | 12.8 | 337. | 8.6 |
| 59 | 150 | 43.4 | 23.7 | 30.9 | 1210. | 4.5 |
| 60 | 150 | 33.6 | 30.6 | 28.9 | 913. | 4.8 |
| 61 | 150 | 54.4 | 18.9 | 30.2 | 1134. | 3.7 |
| 62 | 150 | 13.6 | 71.1 | 10.4 | 272. | 12.2 |
| 63 | 150 | 62.9 | 15.4 | 30.5 | 1008. | 4.0 |
| 64 | 150 | 26.6 | 36.4 | 20.4 | 638. | 7.0 |
| 65 | 150 | 36.1 | 26.8 | 32.0 | 1081. | 5.3 |
| 66 | 150 | 52.0 | 18.6 | 34.0 | 1172. | 4.1 |
| 67 | 150 | 73.3 | 13.2 | 35.3 | 1314. | 3.8 |
| 68 | 140 | 14.6 | 66.1 | 13.9 | 257. | 14.9 |
| 69 | 140 | 30.1 | 32.1 | 28.5 | 933. | 4.5 |
| 70 | 140 | 45.6 | 21.2 | 35.9 | 1440. | 3.9 |
| 71 | 140 | 43.0 | 22.5 | 37.6 | 1460. | 4.1 |
| 72 | 140 | 32.3 | 30.1 | 33.1 | 1170. | 4.3 |
| 73 | 140 | 57.3 | 16.9 | 39.6 | 1547. | 3.8 |
| 74 | 130 | 16.3 | 59.4 | 21.6 | 556. | 5.5 |
| 75 | 130 | 20.6 | 47.0 | 25.6 | 752. | 5.3 |
| 76 | 130 | 36.3 | 26.7 | 33.0 | 1144. | 4.1 |
| 77 | 130 | 49.4 | 19.6 | 30.4 | 1284. | 3.8 |
| 78 | 130 | 24.5 | 44.6 | 26.4 | 990. | 4.5 |

TABLE I-continued

| Ex. | Stretch Temp., °C. | Stretch Ratio | Denier | Tenacity g/d | Modulus g/d | Elong % |
|---|---|---|---|---|---|---|
| 79 | 130 | 28.6 | 38.2 | 27.1 | 975. | 4.5 |
| 80 | 130 | 42.2 | 25.9 | 34.7 | 1200. | 4.4 |
| 81 | 140 | 40.3 | 27.1 | 33.2 | 1260. | 4.0 |
| 82 | 140 | 58.7 | 18.6 | 35.5 | 1400. | 4.0 |
| 83 | 145 | 47.9 | 22.8 | 32.1 | 1460. | 4.0 |
| 84 | 145 | 52.3 | 20.9 | 37.0 | 1500. | 4.0 |
| 85 | 130 | 13.6 | 80.4 | 12.8 | 275. | 8.0 |
| 86 | 130 | 30.0 | 36.4 | 24.8 | 768. | 5.0 |
| 87 | 130 | 29.7 | 36.8 | 28.6 | 1005. | 4.5 |
| 88 | 140 | 52.0 | 21.0 | 36.0 | 1436. | 3.5 |
| 89 | 140 | 11.8 | 92.3 | 10.1 | 151. | 18.5 |
| 90 | 140 | 35.3 | 31.0 | 29.8 | 1004. | 4.5 |
| 91 | 140 | 23.4 | 46.8 | 26.6 | 730. | 5.5 |
| 92 | 150 | 14.6 | 74.9 | 11.5 | 236. | 11.0 |
| 93 | 150 | 35.7 | 30.6 | 27.4 | 876. | 4.5 |
| 94 | 150 | 31.4 | 34.8 | 27.0 | 815. | 5.0 |
| 95 | 150 | 37.8 | 28.9 | 29.8 | 950. | 4.5 |
| 96 | 150 | 15.9 | 68.7 | 9.8 | 210. | 10.0 |
| 97 | 150 | 30.2 | 36.2 | 24.6 | 799. | 5.0 |
| 98 | 150 | 36.1 | 30.3 | 28.2 | 959. | 4.5 |
| 99 | 150 | 64.7 | 16.9 | 32.1 | 1453. | 3.5 |

In order to determine the relatonships of the fiber properties to the process and material parameters, the data of Table I were subjected to statistical analysis by multiple lnear regression. The regression equation obtained for fiber tenacity was as follows:

$$\text{Tenacity, g/d} = -8.47 + 2.00*SR + 0.491*IV + 0.0605*C*SR \; 0.00623*T*SR - 0.0156*IV*SR - 0.00919*SR*SR$$

Where

SR is stretch ratio

IV is polymer intrinsic viscosity in decalin at 135° C., dl/g

C is polymer concentration in the gel, wt%

T is stretch temp. °C.

The statistics of the regression were:

F ratio (6,95)=118 significance level=99.9+% standard error of estimate=3.0 g/d

A comparison between the observed tenacities and tenacities calculated from the regression equation is shown in FIG. 1.

Figure 2:
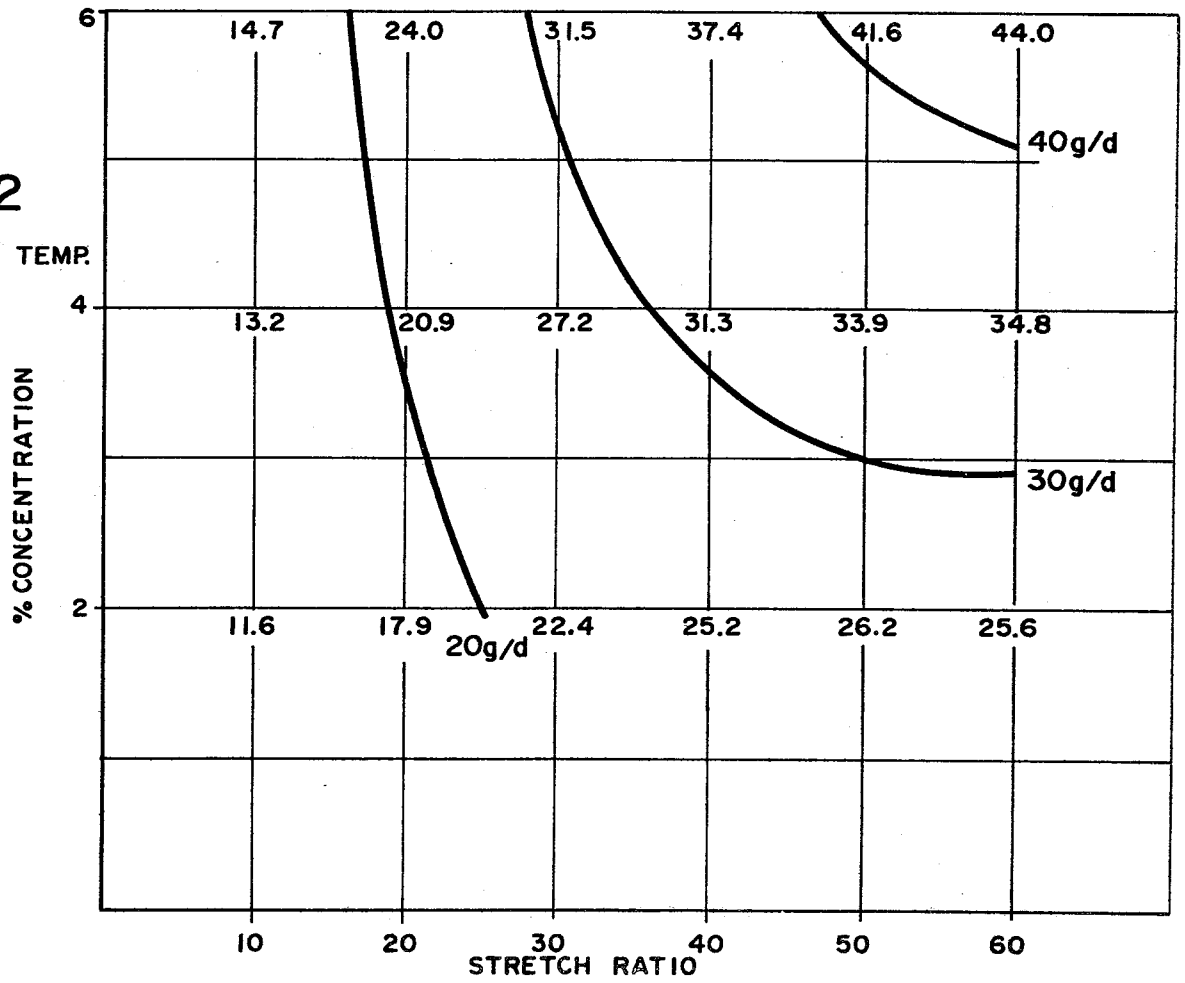
FIG. 2 is a graphic view of the calculated tenacities of polyethylene fibers prepared according to Examples 3–99 as a function of polymer concentration and draw ratio at a constant temperature of 140° C.
Figure 3:
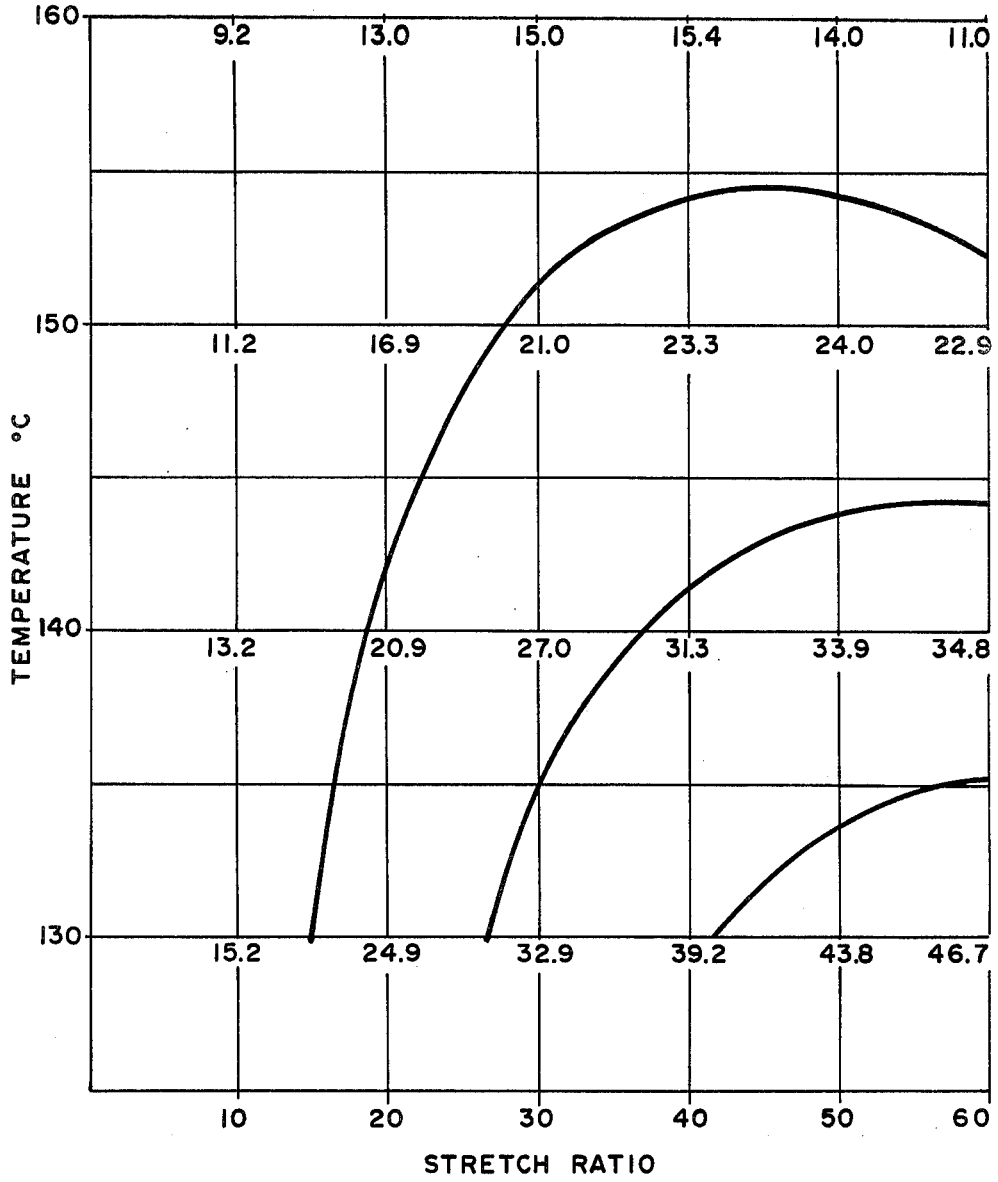
FIG. 3 is a graphic view of the calculated tenacities of polyethylene fibers prepared according to Examples 3–99 as a function of draw temperature and draw (or stretch) ratio at a constant polymer concentration of 4%.

FIGS. 2 and 3 present response surface contours for tenacity calculated from the regression equation on two important planes.

Figure 4:
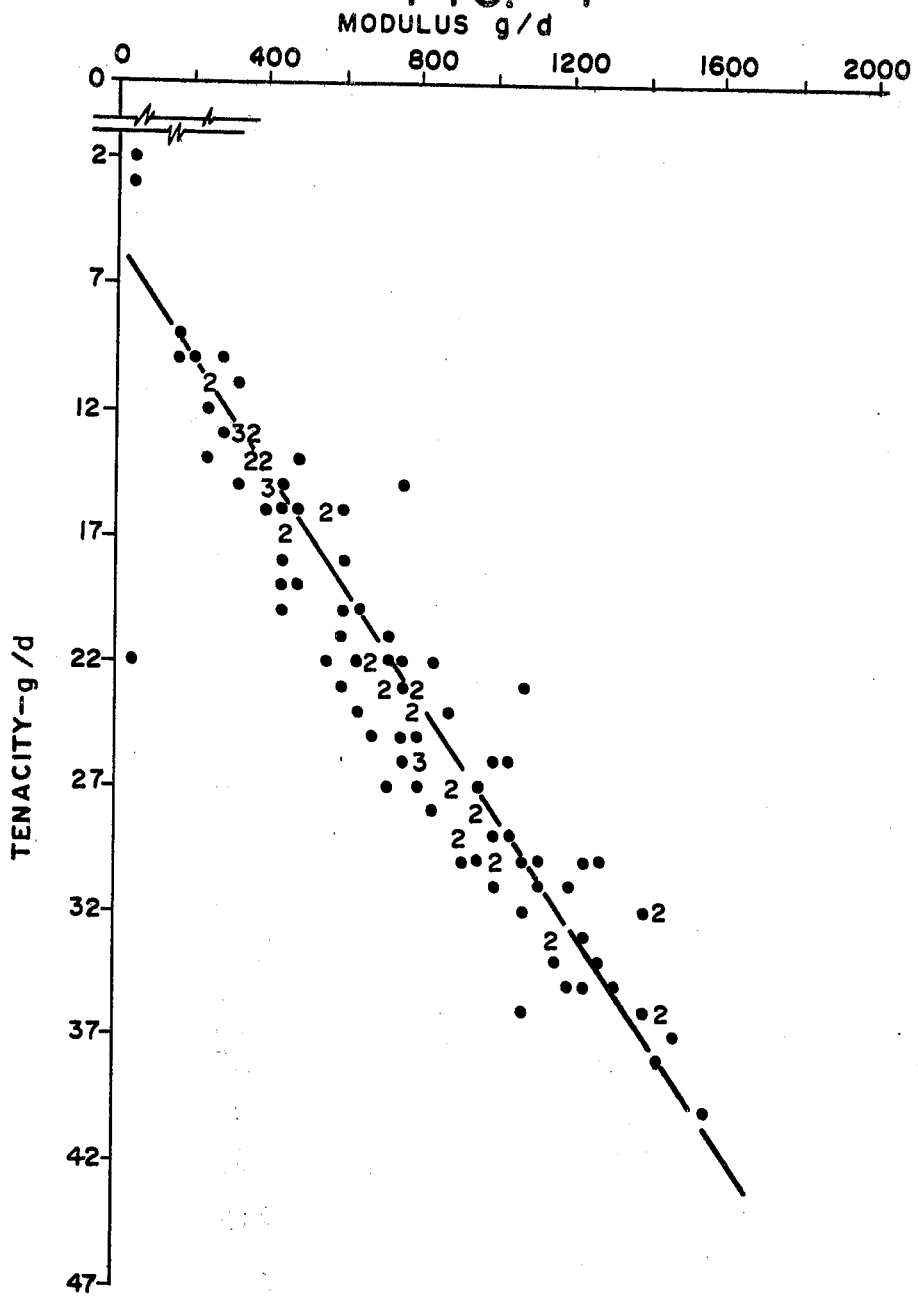
FIG. 4 is a graphic view of tenacity plotted against tensile modulus for polyethylene fibers prepared in accordance with Examples 3–99.

In the experiments of Examples 3–99, a correlation of modulus with spinning parameters was generally parallel to that of tenacity. A plot of fiber modulus versus tenacity is shown in FIG. 4.

It will be seen from the data, the regression equations and the plots of the calculated and observed results that the method of the invention enables substantial control to obtain desired fiber properties and that greater controlability and flexibility is obtained than by prior art methods.

Further, it should be noted that many of the fibers of these examples showed higher teancities and/or modulus values than had been obtained by prior art methods. In the prior art methods of Off. 30 04 699 and GB 2051667, all fibers prepared had tenacities less than 3.0 GPa (35 g/d) and moduli less than 100 GPa (1181 g/d). In the present instance, fiber examples Nos. 21, 67, 70, 73, 82, 84 and 88 exceeded both of these levels and other fiber examples surpassed on one or the other property.

In the prior art publications of Pennings and coworkers, all fibers (prepared discontinuously) had moduli less than 121 GPa (1372 g/d). In the present instance continuous fiber examples No. 70, 71, 73, 82, 83, 84, 88 and 99 surpassed this level.

The fiber of example 71 was further tested for resistance to creep at 23° C. under a sustained load of 10% of the breaking load. Creep is defined as follows:

$$\% \text{ Creep} = 100 \times (A(s,t) - B(s))/B(s)$$

where

B(s) is the length of the test section immediately after application of load

A(s,t) is the length of the test section at time t after application of load, s

A and B are both functions of the loads, while A is also a function of time t.

For comparison, a commercial nylon tire cord (6 denier, 9.6 g/d tenacity) and a polyethylene fiber prepared in accordance with Ser. No. 225,288, filed Jan. 15, 1981 by surface growth and subsequent hot stretching (10 denier, 41.5 g/d tenacity) were similarly tested for creep.

The results of these tests are presented in Table II.

TABLE II

CREEP RESISTANCE AT 23° C.
Load: 10% of Breaking Load

| Time After Application of Load, Days | % Creep: Fiber of Example 71 | Comparative Nylon Tire Cord | Surface Grown & Stretched Polyethylene |
|---|---|---|---|
| 1 | 0.1 | 4.4 | 1.0 |
| 2 | 0.1 | 4.6 | 1.2 |
| 6 | — | 4.8 | 1.7 |
| 7 | 0.4 | — | — |
| 9 | 0.4 | — | — |
| 12 | — | 4.8 | 2.1 |
| 15 | 0.6 | 4.8 | 2.5 |
| 19 | — | 4.8 | 2.9 |
| 21 | 0.8 | — | — |
| 22 | — | 4.8 | 3.1 |
| 25 | 0.8 | — | — |
| 26 | — | 4.8 | 3.6 |
| 28 | 0.9 | — | — |
| 32 | 0.9 | — | — |
| 33 | — | 4.8 | 4.0 |
| 35 | 1.0 | — | — |
| 39 | 1.4 | — | — |
| 40 | — | 4.9 | 4.7 |
| 43 | 1.4 | — | — |
| 47 | 1.4 | — | — |
| 50 | — | 4.9 | 5.5 |
| 51 | 1.4 | — | — |
| 57 | — | 4.9 | 6.1 |
| 59 | 1.45 | — | — |

It will be seen that the fiber of example 71 showed about 1.4% creep in 50 days at 23° C. under the sustained load equal to 10% of the breaking load. By way of comparison, both the commercial nylon 6 tire cord and the surface grown polyethylene fiber showed about 5% creep under similar test conditions.

The melting temperatures and the porosities of the fibers of examples 64, 70 and 71 were determined. Melting temperatures were measured using a DuPont 990 differential scanning calorimeter. Samples were heated in an argon atmosphere at the rate of 10° C./min. Additionally, the melting temperature was determined for the starting polyethylene powder from which the fibers of examples 64, 70 and 71 were prepared.

Porosities of the fibers were determined by measurements of their densities using the density gradient technique and comparison with the density of a compression molded plaque prepared from the same initial polyethylene powder. (The density of the compression molded plaque was 960 kg/m$^3$).

Porosity was calculated as follows:

$$\%, \text{Porosity} = \frac{960 - \text{fiber density, kg/m}^3}{960}$$

Results were as follows:

| Sample | Melting Temp. °C. | Fiber Density, Kg/m$^3$ | Porosity, % |
|---|---|---|---|
| Polyethylene powder | 138 | — | — |
| Fiber of Example 64 | 149 | 982 | 0 |
| Fiber of Example 70 | 149 | 976 | 0 |
| Fiber of Example 71 | 150 | 951 | 1 |

The particular level and combination of properties exhibited by the fiber of examples 64, 70 and 71, i.e., tenacity at least about 30 g/d, modulus in excess of 1000 g/d, and creep (at 23° C. and 10% of breaking load) less than 3% in 50 days, melting temperature of at least about 147° C. and porosity less than about 10% appears not to have been attained heretofore.

The following examples illustrate the effect of the second solvent upon fiber properties.

EXAMPLES 100–108

Fiber samples were prepared as described in Example 2, but with the following variations. The bottom discharge opening of the Helicone mixer was adapted to feed the polymer solution first to a gear pump and thence to a single hole conical spinning die. The cross-section of the spinning die tapered uniformly at a 7.5° angle from an entrance diameter of 10 mm to an exit diameter of 1 mm. The gear pump speed was set to deliver 5.84 cm$^3$/min of polymer solution to the die. The extruded solution filament was quenched to a gel state by passage through a water bath located at a distance of 20 cm below the spinning die. The gel filament was wound up continuously on bobbins at the rate of 7.3 meters/min.

The bobbins of gel fiber were immersed in several different solvents at room temperature to exchange with the paraffin oil as the liquid constituent of the gel. The solvents and their boiling points were:

| Solvent | Boiling Point, °C. |
|---|---|
| diethyl ether | 34.5 |
| n-pentane | 36.1 |
| methylene chloride | 39.8 |
| trichlorotrifluoroethane | 47.5 |
| n-hexane | 68.7 |
| carbon tetrachloride | 76.8 |
| n-heptane | 98.4 |
| dioxane | 101.4 |
| toluene | 110.6 |

The solvent exchanged gel fibers were air dried at room temperature. Drying of the gel fibers was accompanied in each case by substantial shrinkage of transverse dimensions. Surprisingly, it was observed that the shape and surface texture of the xerogel fibers departed progressively from a smooth cylindrical form in approximate proportion to the boiling point of the second solvent. Thus, the fiber from which diethyl ether had been dried was substantially cylindrical whereas the fiber from which toluene had been dried was "C" shaped in cross-section.

The xerogel fibers prepared using TCTFE and n-hexane as second solvents were further compared by stretching each at 130° C., incrementally increasing stretch ratio until fiber breakage occurred. The tensile properties of the resulting fibers were determined as shown in Table III.

It will be seen that the xerogel fiber prepared using TCTFE as the second solvent could be stretched continuously to a stretch ratio of 49/1 and whereas the xerogel fiber prepared using n-hexane could be stretched continuously only to a stretch ratio of 33/1. At maximum stretch ratio, the stretched fiber prepared using TCTFE second solvent was of 39.8 g/d tenacity, 1580 g/d modulus. This compares to 32.0 g/d tenacity, 1140 g/d modulus obtained using n-hexane as the second solvent.

TABLE III

Properties of Xerogel Fibers Stretched at 130° C. Feed Speed: 2.0 cm/min.

| Example | Second Solvent | Stretch Ratio | Tenacity g/d | Modulus g/d | Elong. % |
|---|---|---|---|---|---|
| 100 | TCTFE | 16.0 | 23.3 | 740 | 5.0 |
| 101 | TCTFE | 21.8 | 29.4 | 850 | 4.5 |
| 102 | TCTFE | 32.1 | 35.9 | 1240 | 4.5 |
| 103 | TCTFE | 40.2 | 37.4 | 1540 | 3.9 |
| 104 | TCTFE | 49.3 | 39.8 | 1580 | 4.0 |
| 105 | n-hexane | 24.3 | 28.4 | 1080 | 4.8 |
| 106 | n-hexane | 26.5 | 29.9 | 920 | 5.0 |
| 107 | n-hexane | 32.0 | 31.9 | 1130 | 4.5 |
| 108 | n-hexane | 33.7 | 32.0 | 1140 | 4.5 |

EXAMPLE 110

Following the procedures of Examples 3-99, an 8 wt% solution of isotactic polypropylene of 12.8 intrinsic viscosity (in decalin at 135° C.), approximately $2.1\times10^6$ M.W. was prepared in paraffin oil at 200° C. A gel fiber was spun at 6.1 meters/min. The paraffin oil was solvent exchanged with TCTFE and the gel fiber dried at room temperature. The dried fiber was stretched 25/1 at a feed roll speed of 2 cm/min. Stretching was conducted in a continuous manner for one hour at 160° C.

Fiber properties were as follows:

denier—105
tenacity—9.6 g/d
modulus—164 g/d
elongation—11.5%
work-to-break—9280 in lbs/in$^3$ (64 MJ/m$^3$)

EXAMPLES 111-486

A series of xerogel fiber samples was prepared as in Example 2 but using a gear pump to control melt flow rate. Variations were introduced in the following material and process parameters:

a. polyethylene IV (molecular weight)
b. polymer gel concentration
c. die exit diameter
d. die included angle (conical orifice)
e. spinning temperature
f. melt flow rate
g. distance to quench
h. gel fiber take-up velocity
i. xerogel fiber denier Each of the xerogel fiber samples prepared was stretched in a hot tube of 1.5 meter length blanketed with nitrogen and maintained at 100° C. at the fiber inlet and 140° C. at the fiber outlet. Fiber feed speed into the hot tube was 4 cm/min. (Under these conditions the actual fiber temperature was within 1° C. of the tube temperature at distances beyond 15 cm from the inlet). Each sample was stretched continuously at a series of increasing stretch ratios. The independent variables for these experiments are summarized below:

Polymer Intrinsic Viscosity (dL/g)

11.5—Examples 172-189, 237-241, 251-300, 339-371
15.5—Examples 111-126, 138-140, 167-171, 204-236, 242-243, 372-449, 457-459
17.7—Examples 127-137, 141-166, 190-203, 244-250, 301-338
20.9—Examples 450-456, 467-486

| Gel Concentration | |
|---|---|
| 5% | Examples 127-137, 141-149, 167-171, 190-203, 244-260, 274-276, 291-306, 339-371 |
| 6% | Examples 111-126, 138-140, 204-236, 242-243, 372-418, 431 ∝ 486 |
| 7% | Examples 150-166, 172-189, 237-241, 261-273, 277-290, 307-338 |

| Die Diameter | | |
|---|---|---|
| Inches | Millimeters | |
| 0.04 | 1 | Examples 167-171, 237-241, 244-260, 274-276, 282-290, 301-306, 317-338, 366-371 and 460-466 |
| 0.08 | 2 | Examples 111-166, 172-236, 242, 243, 261-273, 277-281, 291-300, 307-316, 339-365, 372-459 and 467-486. |

| Die Angle (Degrees) | |
|---|---|
| 0° | Examples 127-137, 141-149, 261-281, 307-316, 339-365, 419-430 |
| 7.5° | Examples 111-126, 138-140, 167-171, 204-243, 251-260, 301-306, 317-338, 372-418, 431-486 |
| 15° | Examples 150-166, 172-203, 244-250, 282-300, 366-371 |

| Spinning Temperature | |
|---|---|
| 180° C. | Examples 172-203, 237-241, 301-322, 339-371 |
| 200° C. | Examples 111-126, 138-140, 167-171, 204-236, 242-243, 372-486 |
| 220° C. | Examples 127-137, 141-166, 244-300, 323-338 |

| Solution Flow Rate (cm$^3$/min) | |
|---|---|
| 2.92 ± 0.02 | Examples 116-122, 135-145, 150-152, 162-166, 172-173, 196-201, 214-222, 237, 240, 242-245, 251-255, 260-265, 277-284, 288-293, 301, 304-306, 310-312, 318-320, 347-360, 368-370, 372, 395-397, 401-407, 412-414, 419-424, 450-459, 467-481 |
| 4.37 ± 0.02 | Examples 204-208, 230-236, 377-379, 408-411 |
| 5.85 ± 0.05 | Examples 111-115, 123-134, 146-149, 153-161, 167-171, 180-195, 202-203, 209-213, 223-229, 238-239, 241, 256-259, 266-276, 285-287, 294-300, 302-303, 307-309, 315-317, 321-326, 335-338, 361-367, 371, 373-376, 392-394, 398-400, 415-418, 431-433, 482-486 |
| 6.07 | Examples 339-346 |

-continued

| | |
|---|---|
| 8.76 | Examples 380-391 |
| 8.88 | Examples 246-250 |
| 11.71 ± 0.03 | Examples 434-437, 445-449 |
| 17.29 | Examples 438-440 |

| Distance to Quench | | |
|---|---|---|
| Inches | Millimeters | Examples |
| 5.5 | 140 | 116-126 |
| 6.0 | 152 | 127-137, 158-166, 172-173, 183-198, 222-229, 240-243, 246-259, 282-286, 293-296, 301, 302, 323-330, 366-368, 398-407, 419-430 |
| 6.5 | 165 | 268-273, 277-281 |
| 7.7 | 196 | 167-171 |
| 13.0 | 330 | 450-453 |
| 14.5 | 368 | 377-391 |
| 15.0 | 381 | 230-236, 408-411, 431-449, 454-456, 467-486 |
| 22.5 | 572 | 307-312, 339-349 |
| 23.6 | 600 | 111-115, 138-140 |
| 24.0 | 610 | 141-157, 174-182, 199-203, 209-221, 244-245, 287-292, 297-300, 303-306, 319-322, 331-338, 372, 392-394, 412-418, 460-466 |

Under all of the varied conditions, the take-up velocity varied from 90-1621 cm/min, the xerogel fiber denier from 98-1613, the stretch ratio from 5-174, the tenacity from 9-45 g/denier, the tensile modulus from 218-1700 g/denier and the elongation from 2.5-29.4%.

The results of each Example producing a fiber of at least 30 g/denier (2.5 GPa) tenacity or at least 1000 g/denier (85 GPa) modulus are displayed in Table IV.

TABLE IV

| Stretched Fiber Properties | | | | | |
|---|---|---|---|---|---|
| Example | Xerogel Fiber Denier | Stretch Ratio | Tenacity g/den | Modulus g/den | % Elong |
| 113 | 1599. | 50. | 31. | 1092. | 4.0 |
| 114 | 1599. | 57. | 34. | 1356. | 3.6 |
| 115 | 1599. | 72. | 37. | 1490. | 3.5 |
| 119 | 1837. | 63. | 35. | 1257. | 4.2 |
| 122 | 1289. | 37. | 32. | 988. | 4.5 |
| 126 | 440. | 41. | 31. | 1051. | 4.5 |
| 128 | 1260. | 28. | 31. | 816. | 5.5 |
| 130 | 1260. | 33. | 33. | 981. | 4.5 |
| 131 | 1260. | 43. | 35. | 1179. | 4.0 |
| 132 | 1260. | 40. | 37. | 1261. | 4.5 |
| 133 | 1260. | 39. | 30. | 983. | 4.0 |
| 134 | 1260. | 53. | 36. | 1313. | 4.0 |
| 135 | 282. | 26. | 29. | 1062. | 3.5 |
| 136 | 282. | 26. | 30. | 1034. | 3.5 |
| 137 | 282. | 37. | 30. | 1261. | 3.5 |
| 140 | 168. | 23. | 26. | 1041. | 3.5 |
| 145 | 568. | 40. | 30. | 1157. | 4.0 |
| 146 | 231. | 21. | 32. | 763. | 4.0 |
| 147 | 231. | 23. | 36. | 1175. | 4.2 |
| 148 | 231. | 22. | 33. | 1131. | 4.0 |
| 149 | 231. | 19. | 31. | 1090. | 4.0 |
| 151 | 273. | 31. | 28. | 1117. | 3.5 |
| 157 | 1444. | 64. | 29. | 1182. | 3.0 |
| 160 | 408. | 35. | 30. | 1124. | 4.0 |
| 164 | 1385. | 36. | 32. | 1210. | 4.0 |
| 166 | 1385. | 39. | 33. | 1168. | 4.0 |
| 168 | 344. | 26. | 30. | 721. | 5.0 |
| 169 | 344. | 40. | 32. | 1188. | 4.0 |
| 170 | 344. | 26. | 30. | 1060. | 4.0 |
| 171 | 344. | 29. | 31. | 1172. | 4.0 |
| 179 | 1017. | 68. | 29. | 1179. | 4.0 |
| 182 | 352. | 65. | 33. | 1146. | 3.7 |
| 189 | 1958. | 44. | 27. | 1050. | 3.5 |
| 195 | 885. | 59. | 31. | 1150. | 4.0 |
| 201 | 496. | 33. | 29. | 1082. | 4.0 |
| 206 | 846. | 37. | 31. | 955. | 4.5 |
| 208 | 846. | 63. | 35. | 1259. | 3.5 |

TABLE IV-continued

| Stretched Fiber Properties | | | | | |
|---|---|---|---|---|---|
| Example | Xerogel Fiber Denier | Stretch Ratio | Tenacity g/den | Modulus g/den | % Elong |
| 212 | 368. | 55. | 39. | 1428. | 4.5 |
| 213 | 368. | 49. | 35. | 1311. | 4.0 |
| 220 | 1200. | 81. | 34. | 1069. | 4.0 |
| 221 | 1200. | 60. | 30. | 1001. | 4.0 |
| 227 | 1607. | 42. | 30. | 1050. | 4.0 |
| 228 | 1607. | 47. | 30. | 1114. | 3.5 |
| 229 | 1607. | 53. | 35. | 1216. | 4.0 |
| 233 | 1060. | 34. | 30. | 914. | 4.5 |
| 235 | 1060. | 50. | 37. | 1279. | 4.1 |
| 236 | 1060. | 74. | 45. | 1541. | 4.0 |
| 245 | 183. | 23. | 26. | 1014. | 4.0 |
| 247 | 247. | 16. | 30. | 1005. | 4.5 |
| 248 | 247. | 10. | 30. | 1100. | 4.0 |
| 249 | 247. | 11. | 31. | 1132. | 4.0 |
| 250 | 247. | 19. | 37. | 1465. | 3.8 |
| 251 | 165. | 34. | 31. | 1032. | 4.5 |
| 252 | 165. | 33. | 31. | 998. | 4.5 |
| 254 | 165. | 41. | 31. | 1116. | 4.0 |
| 255 | 165. | 40. | 29. | 1115. | 4.0 |
| 272 | 1200. | 41. | 24. | 1122. | 3.0 |
| 273 | 1200. | 64. | 27. | 1261. | 2.5 |
| 274 | 154. | 27. | 30. | 854. | 4.5 |
| 275 | 154. | 44. | 32. | 1063. | 4.5 |
| 276 | 154. | 38. | 30. | 1054. | 4.0 |
| 280 | 291. | 39. | 30. | 978. | 4.0 |
| 281 | 291. | 43. | 29. | 1072. | 4.0 |
| 284 | 254. | 30. | 32. | 1099. | 4.5 |
| 308 | 985. | 27. | 30. | 900. | 4.3 |
| 309 | 985. | 34. | 35. | 1210. | 3.8 |
| 311 | 306. | 30. | 31. | 990. | 4.4 |
| 312 | 306. | 30. | 32. | 1045. | 4.0 |
| 314 | 1234. | 45. | 37. | 1320. | 4.0 |
| 315 | 344. | 25. | 30. | 970. | 4.0 |
| 317 | 254. | 29. | 32. | 1270. | 3.5 |
| 320 | 190. | 29. | 30. | 1060. | 4.0 |
| 322 | 307. | 25. | 29. | 1030. | 4.0 |
| 323 | 340. | 25. | 34. | 1293. | 4.1 |
| 324 | 340. | 23. | 33. | 996. | 4.4 |
| 325 | 340. | 30. | 37. | 1241. | 4.1 |
| 326 | 340. | 35. | 39. | 1480. | 3.7 |
| 327 | 373. | 24. | 30. | 920. | 4.5 |
| 328 | 373. | 27. | 34. | 1080. | 4.5 |
| 329 | 373. | 30. | 36. | 1349. | 4.0 |
| 330 | 373. | 35. | 37. | 1377. | 3.9 |
| 332 | 218. | 34. | 35. | 1320. | 3.9 |
| 333 | 218. | 30. | 37. | 1364. | 4.0 |
| 334 | 218. | 30. | 31. | 1172. | 3.9 |
| 335 | 326. | 26. | 37. | 1260. | 4.5 |
| 336 | 326. | 30. | 39. | 1387. | 4.2 |
| 337 | 326. | 42. | 42. | 1454. | 4.0 |
| 338 | 326. | 42. | 37. | 1440. | 3.9 |
| 339 | 349. | 55. | 29. | 1330. | 3.3 |
| 345 | 349. | 31. | 29. | 1007. | 4.5 |
| 346 | 349. | 51. | 34. | 1165. | 4.3 |
| 357 | 772. | 45. | 31. | 990. | 4.4 |
| 358 | 772. | 51. | 27. | 1356. | 3.0 |
| 359 | 772. | 58. | 32. | 1240. | 3.7 |
| 360 | 772. | 59. | 33. | 1223. | 3.8 |
| 364 | 293. | 47. | 38. | 1407. | 4.5 |
| 375 | 1613. | 50. | 30. | 960. | 4.1 |
| 379 | 791. | 46. | 32. | 1110. | 3.9 |
| 382 | 1056. | 68. | 34. | 1280. | 3.7 |
| 383 | 921. | 51. | 31. | 1090. | 4.0 |
| 386 | 1057. | 89. | 34. | 1250. | 3.8 |
| 387 | 984. | 59. | 33. | 1010. | 4.3 |
| 394 | 230. | 29. | 31. | 982. | 4.3 |
| 400 | 427. | 32. | 30. | 970. | 4.1 |
| 405 | 1585. | 39. | 33. | 1124. | 3.6 |
| 407 | 1585. | 174. | 32. | 1040. | 4.0 |
| 418 | 1370. | 51. | 33. | 1160. | 3.7 |
| 419 | 344. | 23. | 30. | 1170. | 3.8 |
| 421 | 1193. | 30. | 31. | 880. | 4.6 |
| 422 | 1193. | 39. | 35. | 1220. | 3.9 |
| 423 | 1193. | 51. | 34. | 1310. | 3.4 |
| 424 | 1193. | 50. | 36. | 1390. | 3.6 |
| 426 | 1315. | 32. | 30. | 860. | 4.4 |
| 427 | 1315. | 42. | 33. | 1160. | 3.9 |

TABLE IV-continued

| Example | Xerogel Fiber Denier | Stretch Ratio | Tenacity g/den | Modulus g/den | % Elong |
|---|---|---|---|---|---|
| | Stretched Fiber Properties | | | | |
| 428 | 1315. | 46. | 34. | 1170. | 3.8 |
| 429 | 395. | 19. | 35. | 840. | 4.5 |
| 430 | 395. | 25. | 31. | 1100. | 3.9 |
| 435 | 1455. | 36. | 31. | 920. | 4.3 |
| 436 | 1455. | 43. | 31. | 1120. | 3.6 |
| 437 | 1455. | 51. | 33. | 1060. | 3.3 |
| 440 | 1316. | 37. | 32. | 1130. | 4.0 |
| 441 | 453. | 31. | 32. | 990. | 4.7 |
| 442 | 453. | 49. | 39. | 1320. | 4.4 |
| 443 | 453. | 34. | 33. | 1060. | 4.4 |
| 444 | 453. | 55. | 36. | 1410. | 3.6 |
| 446 | 402. | 28. | 30. | 1107. | 4.0 |
| 447 | 402. | 22. | 30. | 870. | 5.0 |
| 448 | 402. | 34. | 36. | 1175. | 4.3 |
| 449 | 402. | 38. | 37. | 1256. | 4.3 |
| 451 | 461. | 33. | 33. | 1070. | 4.4 |
| 452 | 461. | 38. | 35. | 1130. | 4.1 |
| 453 | 461. | 40. | 35. | 1220. | 3.7 |
| 454 | 64. | 14. | 34. | 1080. | 4.7 |
| 455 | 64. | 17. | 35. | 1263. | 3.4 |
| 456 | 64. | 26. | 40. | 1453. | 3.8 |
| 460 | 268. | 32. | 35. | 1220. | 4.3 |
| 462 | 268. | 29. | 34. | 1100. | 4.2 |
| 463 | 268. | 32. | 34. | 1110. | 4.1 |
| 464 | 268. | 43. | 40. | 1390. | 3.9 |
| 465 | 420. | 53. | 41. | 1550. | 3.7 |
| 466 | 420. | 27. | 31. | 1010. | 4.0 |
| 467 | 371. | 24. | 31. | 960. | 4.4 |
| 468 | 371. | 63. | 45. | 1560. | 3.9 |
| 470 | 1254. | 40. | 35. | 1100. | 4.1 |
| 471 | 1254. | 43. | 37. | 1190. | 4.0 |
| 472 | 1254. | 45. | 38. | 1320. | 4.0 |
| 473 | 1254. | 66. | 39. | 1600. | 3.5 |
| 474 | 210. | 44. | 43. | 1700. | 3.5 |
| 475 | 210. | 21. | 34. | 1170. | 4.0 |
| 476 | 210. | 27. | 38. | 1420. | 3.6 |
| 479 | 1227. | 50. | 34. | 1180. | 4.1 |
| 480 | 1227. | 48. | 33. | 1140. | 4.1 |
| 481 | 1227. | 44. | 35. | 1230. | 4.1 |
| 483 | 1294. | 29. | 31. | 1000. | 4.3 |
| 484 | 1294. | 42. | 36. | 1350. | 3.7 |
| 485 | 340. | 26. | 32. | 1160. | 3.8 |
| 486 | 340. | 18. | 27. | 1020. | 4.1 |

In order to determine the relationships of the fiber properties to the process and material parameters, all of the data from Example 111-486, including those Examples listed in Table IV, were subjected to statistical analysis by multiple linear regression. The regression equation obtained for fiber tenacity was as follows:

$$\begin{aligned}\text{Tenacity, g/d} = {} & 11.88 + 2.221IV' + 1.147C' + 1.948TM' \\ & + 0.822Q' - 1.167L' - 2.438DO' + 0.532SR \\ & - 0.7261V'DA' + 1.399IV'TM' + 0.534IV'L' \\ & + 0.046IV'SR - 0.754C'DA' - 0.391C'Q' - 0.419C'DO' \\ & - 1.327D'TM' + 0.366D'L' - 0.577DA'TM' \\ & - 0.790DA'Q' - 0.034DA'SR - 0.049TM'SR \\ & + 0.809Q'L' - 0.313Q'DO' - 0.334(IV')^2 \\ & + 0.115(L')^2 + 0.564(DO')^2 - 0.00237(SR)^2\end{aligned}$$

where:

IV'=(polymer IV, dL/g—14.4)/3.1

C'=Gel concentration, %—6

TM'=(spinning temp. °C.—200)/20

Q'=(spin flow rate, cc/min—4.38)/1.46

L'=(distance to quench, in—15)/9

DO'=1.4427 log (xerogel fiber denier/500)

SR=stretch ratio (xerogel fiber denier/stretched fiber denier)

DA'=(die angle, °—7.5)/7.5

D'=(die exit diameter, inches—0.06)/0.02

The statistics of the reggression were;

F ratio (26, 346)=69

Significance Level=99.9+%

Standard error of estimate=2.6 g/denier

In the vicinity of the center of the experimental space these effects may be summarized by considering the magnitude of change in the factor which is required to increase tenacity of 1 g/d. This is given below.

| Factor | Factor Change Required to Increase Tenacity By 1 g/denier | |
|---|---|---|
| IV | +1 | dL/g |
| Conc. | +1 | wt % |
| Spin Temp. | +10 | °C. |
| Spin Rate | ±(saddle) | cc/min |
| Die Diam. | −0.010 | inches |
| Die Angle | −2 | degrees |
| Dist. to Quench | −4 | inches |
| Xerogel Fiber Denier | −25 | |
| Stretch Ratio | +2/1 | |

High fiber tenacity was favored by increasing polymer IV, increasing gel concentration, increasing spinning temperature, decreasing die diameter, decreasing distance to quench, decreasing xerogel fiber diameter, increasing stretch ratio and 0° die angle (straight capillary).

It will be seen that the method of the invention enables substantial control to obtain desired fiber properties and that greater controlability and flexability is obtained than by prior art methods.

In these experiments, the effects of process parameters upon fiber modulus generally paralled the effects of these variables upon tenacity. Fiber modulus was correlated with tenacity as follows modulus, g/d=42(tenacity, g/d)−258

Significance of the correlation between modulus and tenacity was 99.99+%. Standard error of the estimate of modulus was 107 g/d.

It should be noted that many of the fibers of these examples show higher tenacities and/or higher modulus than had seen obtained by prior art methods.

The densities and porosities of several of the xerogel and stretched fibers were determined.

| Example | Xerogel fiber Density kg/m³ | Xerogel fiber % Porosity | Stretched fiber Density, kg/m³ | Stretched fiber % Porosity |
|---|---|---|---|---|
| 115 | 934 | 2.7 | — | — |
| 122 | 958 | 0.2 | 0.965 | 0 |
| 126 | 958 | 0.2 | — | — |
| 182 | 906 | 5.6 | 940 | 2.1 |

The porosities of these samples were substantially lower than in the prior art methods cited earlier.

EXAMPLES 487-583

In the following examples of multi-filament spinning and stretching, polymer solutions were prepared as in Example 2. The solutions were spun through a 16 hole spinning die using a gear pump to control solution flow rate. The aperatures of the spinning die were straight capillaries of length-to-diameter ratio of 25/1. Each capillary was preceded by a conical entry region of 60° included angle.

The multi-filament solution yarns were quenched to a gel state by passing through a water bath located at a short distance below the spinning die. The gel yarns were wound up on perforated dye tubes.

EXAMPLES 487–495

ONE STAGE "DRY STRETCHING" OF MULTI-FILAMENT YARN

The wound tubes of gel yarn were extracted with TCTFE in a large Sohxlet apparatus to exchange this solvent for paraffin oil as the liquid constituent of the gel. The gel fiber was unwound from the tubes and the TCTFE solvent was evaporated at room temperature.

The dried xerogel yarns were stretched by passing the yarn over a slow speed feed godet and idler roll through a hot tube blanketed with nitrogen, onto a second godet and idler roller driven at a higher speed. The stretched yarn was collected on a winder.

It was noted that some stretching of the yarn (approximately 2/1) occurred as it departed the feed godet and before it entered the hot tube. The overall stretch ratio, i.e., the ratio of the surface speeds of the godets, is given below.

In examples 487–495, the diameter of each hole of the 16 filament spinning die was 0.040 inch one millimeter) the spinning temperature was 220° C., the stretch temperature (in the hot tube) was 140° C. and the feed roll speed during stretching was 4 cm/min. In examples 487–490 the polymer IV was 17.5 and the gel concentration was 7 weight %. In examples 491–495 the polymer IV was 22.6. The gel concentration was 9 weight % in example 491, 8 weight % in examples 492–493 and 6 weight % in examples 494 and 495. The distance from the die face to the quench bath was 3 inches (7.52 cm) in examples 487, 488, 494 and 495 and 6 inches (15.2 cm) in examples 490–493. The other spinning conditions and the properties of the final yarns were as follows:

| | | Yarn Properties | | | | | |
|---|---|---|---|---|---|---|---|
| Ex. No. | Spin Rate cc/min-fil | Gel Fiber Take-up Speed cc/min | SR | Denier | Ten g/d | Mod g/d | % Elong |
| 487 | 1.67 | 1176 | 35 | 41 | 36 | 1570 | 3.3 |
| 488 | 2.86 | 491 | 25 | 136 | 27 | 1098 | 3.7 |
| 489 | 2.02 | 337 | 25 | 132 | 29 | 1062 | 3.6 |
| 490 | 2.02 | 337 | 30 | 126 | 31 | 1275 | 3.5 |
| 491 | 1.98 | 162 | 25 | 151 | 33 | 1604 | 3.0 |
| 492 | 1.94 | 225 | 25 | 227 | 29 | 1231 | 3.3 |
| 493 | 1.94 | 225 | 30 | 143 | 34 | 1406 | 3.3 |
| 494 | 1.99 | 303 | 30 | 129 | 34 | 1319 | 3.4 |
| 495 | 1.99 | 303 | 35 | 112 | 35 | 1499 | 3.2 |

EXAMPLES 496–501

ONE STAGE "WET STRETCHING" OF MULTI-FILAMENT YARN

The wound gel yarns still containing the paraffin oil were stretched by passing the yarn over a slow speed feed godet and idler roll through a hot tube blanketed with nitrogen onto a second godet and idler roll driven at high speed. It was noted that some stretching of the yarn (approximately 2/1) occurred as it departed the feed godet and before it entered the hot tube. The overall stretch ratio, i.e., the ratio of the surface speeds of the godets is given below. The stretching caused essentially no evaporation of the paraffin oil (the vapor pressure of the paraffin oil is about 0.001 atmospheres at 149° C.). However, about half of the paraffin oil content of the gel yarns was exuded during stretching. The stretched gel yarns were extracted with TCTFE in a Sohxlet apparatus, then unwound and dried at room temperature.

In each of the examples 496–501 the spinning temperatures was 220° C., the gel concentration was 6 weight % the distance from the spinning die to the water quench was 3 inches (7.6 cm).

In examples 496 and 499–501 the diameter of each hole of the spinning die was 0.040 inches (0.1 cm). In examples 497 and 498 the hole diameters were 0.030 inches (0.075 cm). In examples 496 and 494–501 the polymer IV was 17.5. In examples 497 and 498 the polymer IV was 22.6. The other spinning conditions and properties of the final yarns were as follows:

| Ex. No. | Spinning Rate cc/min-fil | Gel Fiber Take-up Speed cm/min | Stretch Temp | Stretch Ratio | Denier |
|---|---|---|---|---|---|
| 496 | 2.02 | 313 | 140 | 22 | 206 |
| 497 | 1.00 | 310 | 140 | 12.5 | 136 |
| 498 | 1.00 | 310 | 140 | 15 | 94 |
| 499 | 2.02 | 313 | 120 | 20 | 215 |
| 500 | 2.02 | 313 | 120 | 22.5 | 192 |
| 501 | 2.02 | 313 | 120 | 20 | 203 |

| Ex. No. | Tenacity g/d | Modulus g/d | % Elong |
|---|---|---|---|
| 496 | 25 | 1022 | 3.7 |
| 497 | 28 | 1041 | 3.6 |
| 498 | 32 | 1389 | 2.8 |
| 499 | 30 | 1108 | 4.5 |
| 500 | 30 | 1163 | 4.2 |
| 501 | 27 | 1008 | 4.2 |

EXAMPLES 502–533

In the following examples a comparison is made between alternative two stage modes of stretching the same initial batch of yarn. All stretching was done in a hot tube blanketed with nitrogen.

EXAMPLE 502

GEL YARN PREPARATION

The gel yarn was prepared from a 6 weight % solution of 22.6 IV polyethylene as in example 2. The yarn was spun using a 16 hole×0.030 inch (0.075 cm) die. Spinning temperature was 220° C. Spin rate was 1 $cm^3$/min-fil. Distance from the die face to the quench bath was 3 inches (7.6 cm). Take-up speed was 308 cm/min. Nine rolls of 16 filament gel yarn was prepared.

EXAMPLES 503–576

"WET-WET" STRETCHING

In this mode the gel yarn containing the paraffin oil was stretched twice. In the first stage, three of the rolls of 16 filament gel yarns described in example 502 above were combined and stretched together to prepare a 48 filament stretched gel yarn. The first stage stretching conditions were: Stretch temperature 120° C., feed speed 35 cm/min, stretch ratio 12/1. A small sample of the first stage stretched gel yarn was at this point extracted with TCTFE, dried and tested for tensile properties. The results are given below as example 503.

The remainder of the first stage stretched gel yarn was restretched at 1 m/min feed speed. Other second stage stretching conditions and physical properties of the stretched yarns are given below.

| Ex. No. | 2nd Stage Stretch Temp - °C. | 2nd Stage Stretch Ratio | Denier | Tenacity g/d |
|---|---|---|---|---|
| 503 | — | — | 504 | 22 |
| 504 | 130 | 1.5 | 320 | 28 |
| 505 | 130 | 1.75 | 284 | 29 |
| 506 | 130 | 2.0 | 242 | 33 |
| 507 | 140 | 1.5 | 303 | 31 |
| 508 | 140 | 1.75 | 285 | 32 |
| 509 | 140 | 2.25 | 222 | 31 |
| 510 | 145 | 1.75 | 285 | 31 |
| 511 | 145 | 2.0 | 226 | 32 |
| 512 | 145 | 2.25 | 205 | 31 |
| 513 | 150 | 1.5 | 310 | 28 |
| 514 | 150 | 1.7 | 282 | 28 |
| 515 | 150 | 2.0 | 225 | 33 |
| 516 | 150 | 2.25 | 212 | 31 |

| Ex. No. | Modulus g/d | % Elong | Melting* Temp, °C. |
|---|---|---|---|
| 503 | 614 | 5.5 | 147 |
| 504 | 1259 | 2.9 | — |
| 505 | 1396 | 2.6 | 150, 157 |
| 506 | 1423 | 2.8 | — |
| 507 | 1280 | 3.1 | — |
| 508 | 1367 | 3.0 | 149, 155 |
| 509 | 1577 | 2.6 | — |
| 510 | 1357 | 3.0 | — |
| 511 | 1615 | 2.7 | — |
| 512 | 1583 | 2.5 | 151, 156 |
| 513 | 1046 | 3.0 | — |
| 514 | 1254 | 2.9 | — |
| 515 | 1436 | 2.9 | — |
| 516 | 1621 | 2.6 | 152, 160 |

*The unstretched xerogel melted at 138° C.

The density of the fiber of example 515 was determined to be 980 kg/m$^3$. The density of the fiber was therefore higher than the density of a compression molded plaque and the porosity was essentially zero.

EXAMPLES 517–522

"WET-DRY" STRETCHING

In this mode the gel yarn was stretched once then extracted with TCTFE, dried and stretched again.

In the first stage, three of the rolls of 16 filament gel yarn described in Example 502 were combined and stretched together to prepare a 48 filament stretched gel yarn. The first stage stretching conditions were: stretch temperature 120° C., feed speed 35 cm/min, stretch ratio 12/1.

The first stage stretchd gel yarn was extracted with TCTFE in a Sohxlet apparatus, rewound and air dried at room temperature, then subjected to a second stage of stretching in the dry state at a feed speed of 1 m/min. Other second stage stretching conditions and physical properties of the stretching yarn are given below..

| Example | 2nd Stage Stretch Temp, °C. | 2nd Stage Stretch Ratio | Denier | Ten g/d | Mod g/d | % Elong. | Melt Temp, °C. |
|---|---|---|---|---|---|---|---|
| 517 | 130 | 1.25 | 390 | 22 | 1193 | 3.0 | — |
| 518 | 130 | 1.5 | 332 | 26 | 1279 | 2.9 | 150, 157 |
| 519 | 140 | 1.5 | 328 | 26 | 1291 | 3.0 | — |
| 520 | 140 | 1.75 | 303 | 27 | 1239 | 2.7 | 150, 159 |
| 521 | 150 | 1.75 | 292 | 31 | 1427 | 3.0 | — |

-continued

| Example | 2nd Stage Stretch Temp, °C. | 2nd Stage Stretch Ratio | Denier | Ten g/d | Mod g/d | % Elong. | Melt Temp, °C. |
|---|---|---|---|---|---|---|---|
| 522 | 150 | 2.0 | 246 | 31 | 1632 | 2.6 | 152, 158 |

EXAMPLES 523–533

"DRY-DRY" STRETCHING

In this mode the gel yarn described in example 502 was extracted with TCTFE, dried, then stretched in two stages. In the first stage, three of the rolls of 16 filament yarn were combined and stretched together to prepare a 48 filament stretched xerogel yarn. The first stage stretching conditions were: stretch temperature 120° C., feed speed 35 cm/min., stretch ratio 10/1. The properties of the first stage stretched xerogel yarn are given as example 523 below. In the second stretch stage the feed speed was 1 m/min. Other second stage stretching conditions and physical properties of the stretched yarns are given below.

| Example | Stretch Temp, °C. | SR | Denier | Ten g/d | Mod g/d | % Elong. | Melt Temp, °C. |
|---|---|---|---|---|---|---|---|
| 523 | — | — | 392 | 21 | 564 | 4.3 | 146, 153 |
| 524 | 130 | 1.5 | 387 | 24 | 915 | 3.1 | — |
| 525 | 130 | 1.75 | 325 | 23 | 1048 | 2.4 | 150, 158 |
| 526 | 140 | 1.5 | 306 | 28 | 1158 | 2.9 | — |
| 527 | 140 | 1.75 | 311 | 28 | 1129 | 2.9 | — |
| 528 | 140 | 2.0 | 286 | 24 | 1217 | 2.3 | 150, 157 |
| 529 | 150 | 1.5 | 366 | 26 | 917 | 3.3 | — |
| 530 | 150 | 1.75 | 300 | 28 | 1170 | 3.0 | — |
| 531 | 150 | 2.0 | 273 | 31 | 1338 | 3.8 | — |
| 532 | 150 | 2.25 | 200 | 32 | 1410 | 2.2 | — |
| 533 | 150 | 2.5 | 216 | 33 | 1514 | 2.5 | 152, 156 |

The density of the fiber of example 529 was determined to be 940 Kg/m$^3$. The porosity of the fiber was therefore about 2%.

EXAMPLES 534–542

MULTI-STAGE STRETCHING OF MULTI-FILAMENT YARN

In the following examples a comparison is made between two elevated temperatures stretches and a three stage stretch with the first stage at room temperature. The same initial batch of polymer solution was used in these examples.

EXAMPLE 534

UNSTRETCHED GEL YARN PREPARATION

A 6 weight % solution of 22.6 IV polyethylene yarn was prepared as in example 2. A 16 filament yarn was spun and wound as in example 502.

EXAMPLE 535

PREPARATION OF GEL YARN STRETCHED AT ROOM TEMPERATURE

The unstretched gel yarn prepared as in example 534 was led continuously from a first godet which set the spinning take-up speed to a second godet operating at a surface speed of 616 cm/min. In examples 540–542 only, the as-spun gel fiber was stretched 2/1 at room temperature in-line with spinning. The once stretched gel fiber was wound on tubes.

EXAMPLES 536–542

The 16 filament gel yarns prepared in examples 534 and 535 were stretched twice at elevated temperature. In the first of such operations the gel yarns were fed at 35 cm/min to a hot tube blanketed with nitrogen and maintained at 120° C. In the second stage of elevated temperature stretching the gel yarns were fed at 1 m/min and were stretching at 150° C. Other stretching conditions and yarn properties are given below.

| Example | SR RT | SR 120° C. | SR 150° C. | Total SR | Denier | Ten g/den | Mod g/den | Elong |
|---|---|---|---|---|---|---|---|---|
| 536 | — | 8.3 | 2.25 | 18.7 | 128 | 23 | 1510 | 2.6 |
| 537 | — | 8.3 | 2.5 | 20.8 | 116 | 30 | 1630 | 3.0 |
| 538 | — | 8.3 | 2.75 | 22.8 | 108 | 30 | 1750 | 2.7 |
| 539 | — | 8.3 | 3.0 | 24.9 | 107 | 31 | 1713 | 2.6 |
| 540 | 2 | 6.8 | 2.0 | 27.2 | 95 | 30 | 1742 | 2.5 |
| 541 | 2 | 6.8 | 2.25 | 30.6 | 84 | 34 | 1911 | 2.5 |
| 542 | 2 | 6.8 | 2.5 | 34 | 75 | 32 | 1891 | 2.2 |

EXAMPLES 543–551

POLYETHYLENE YARNS OF EXTREME MODULUS

The highest experimental value reported for the modulus of a polyethylene fiber appears to be by P. J. Barham and A. Keller, J. Poly. Sci., Polymer Letters ed. 17, 591 (1979). The measurement 140 GPa (1587 g/d) was made by a dynamic method at 2.5 Hz and 0.06% strain and is expected to be higher than would be a similar measurement made by A.S.T.M. Method D2101 "Tensile Properties of Single Man Made Fibers Taken from Yarns and Tows" or by A.S.T.M. Method D2256 "Breaking Load (Stength) and Elongation of Yarn by the Single Strand Method." The latter methods were used in obtaining the data reported here.

The following examples illustrate the preparation of novel polyethylene yarns of modulus exceeding 1600 g/d and in some cases of modulus exceeding 2000 g/d. Such polyethylene fibers and yarns were heretofore unknown. In the following examples all yarns were made from a 22.6 IV polyethylene, 6 weight % solution prepared as in example 2 and spun in example 502. All yarns were stretched in two stages. The first stage stretch was at a temperature of 120° C. The second stage stretch was at a temperature of 150° C. Several 16 filament yarn ends may have been combined during stretching. Stretching conditions and yarn properties are given below.

| Example | Feed-1 cm/min | SR-1 | Feed-2 cm/min | SR-2 | Fils | Ten g/den | Mod g/den | Elong |
|---|---|---|---|---|---|---|---|---|
| | | | Wet - Wet | | | | | |
| 543 | 25 | 15 | 100 | 2.25 | 48 | 39 | 1843 | 2.9 |
| 544 | 35 | 12.5 | 100 | 2.5 | 64 | 31 | 1952 | 2.6 |
| 545 | 35 | 10.5 | 100 | 2.75 | 48 | 31 | 1789 | 2.4 |
| 546 | 100 | 6.4 | 200 | 2.85 | 48 | 27 | 1662 | 2.5 |
| | | | Wet - Dry | | | | | |
| 547 | 25 | 15 | 100 | 2.0 | 48 | 36 | 2109 | 2.5 |
| 548 | 25 | 15 | 100 | 2.0 | 48 | 32 | 2305 | 2.5 |
| 549 | 25 | 15 | 100 | 2.0 | 48 | 30 | 2259 | 2.3 |
| 550 | 25 | 15 | 100 | 1.87 | 48 | 35 | 2030 | 2.7 |
| 551 | 25 | 15 | 100 | 1.95 | 16 | 35 | 1953 | 3.0 |

The yarns of examples 548 and 550 were characterized by differential scanning calorimetry and density measurement. The results, displayed below, indicate two distinct peaks at the melting points indicated, quite unlike the broad single peak at 145.5° C. or less reported by Smith and Lemstra in J. Mat. Sci., vol 15, 505 (1980).

| Example | Melt Temp(s) | Density | % Porosity |
|---|---|---|---|
| 548 | 147, 155° C. | 977 kg/m$^3$ | 0 |
| 550 | 149, 156° C. | 981 kg/m$^3$ | 0 |

EXAMPLES 552–558

POLYPROPYLENE YARNS OF EXTREME MODULUS

The highest reported experimental value for the modulus of a polypropylene material (fiber or other form) appears to be by T. Williams, J. Mat. Sci. 8, 59 (1973). Their value on a solid state extruded billet was 16.7 GPa (210 g/d). The following examples illustrate the preparation of novel polypropylene continuous fibers with modulus exceeding 220 g/d and in some cases of modulus exceeding 250 g/d.

In the following examples all fibers were made from an 18 IV polypropylene, 6 weight % solution in paraffin oil prepared as in example 2. In Examples 552–556, the fibers were spun with a single hole conical die of 0.040" (0.1 cm) exit diameter and 7.5% angle. Melt temperature was 220° C. A melt pump was used to control solution flow rate at 2.92 cm$^3$/min. Distance from the die face to the water quench was 3 inches (7.6 cm). The gel fibers were one stage wet stretched at 25 cm/min feed roll speed into a 1.5 m hot tube blanketed with nitrogen. The stretched fibers were extracted in TCTFE and air dried. Other spinning and stretching conditions as well as fiber properties are given below.

| Example | Gel Fiber Take-up Speed | Stretch Temp °C. | SR | Denier | Ten g/d | Mod g/d | Elong |
|---|---|---|---|---|---|---|---|
| 552 | 432 | 139 | 10 | 33 | 13.0 | 298 | 15.8 |
| 553 | 432 | 138 | 10 | 34 | 13.0 | 259 | 18.3 |

-continued

| Example | Gel Fiber Take-up Speed | Stretch Temp °C. | SR | Denier | Ten g/d | Mod g/d | Elong |
|---|---|---|---|---|---|---|---|
| 554 | 317 | 140 | 5 | 45 | 11.2 | 262 | 19.9 |
| 555 | 317 | 140 | 10 | 51 | 11.0 | 220 | 19.6 |
| 556 | 317 | 150 | 10 | 61 | 8.8 | 220 | 29.8 |

The fiber of example 556 determined by differential scanning calorimetry to have a first melting temperature of 170°-171° C. with higher order melting temperatures of 173° C., 179° C. and 185° C. This compares with the 166° C. melting point of the initial polymer. The moduli of these fibers substantially exceed the highest previously reported values.

In Examples 557 and 558, the yarns were spun with a 16 hole×0.040 inch (1 mm) capillary die. The solution temperature was 223° C., and the spinning rate was 2.5 $cm^3$/min-filament. The distance from the die face to the water quench bath was 3 inches (7.6 cm). Take-up speed was 430 cm/min. The gel yarns were "wet-wet" stretched in two stages. The first stage stretching was at 140° C. at a feed speed of 35 cm/min. The second stage stretching was at a temperature of 169° C., a feed speed of 100 cm/min and a stretch ratio of 1.25/1. Other stretching conditions as well as fiber properties are given below.

| Example | SR-1 | Denier | Ten g/den | Mod g/den | % Elong. |
|---|---|---|---|---|---|
| 557 | 9.5 | 477 | 10 | 368 | 6.8 |
| 558 | 9.0 | 405 | 10 | 376 | 5.7 |

The moduli of these yarns very substantially exceed the highest previously reported values.

We claim:

1. A stretched polyethylene fiber of substantially indefinite length being of weight average molecular weight at least about 500,000 and having a tenacity of at least about 20 g/denier, a tensile modulus at least about 500 g/denier, a creep value no more than about 5% (when measured at 10% of breaking load for 50 days at 23° C.), a porosity less than about 10% and a main melting temperature of at least about 147° C. (measured at 10° C./minute heating rate by differential scanning calorimetry).

2. The stretched polyethylene fiber of claim 1 having a tenacity of at least about 30 g/denier and a tensile modulus of at least about 1000 g/denier.

3. The stretched polyethylene fiber of claim 2 having a tensile modulus of at least about 1600 g/denier.

4. The stretched polyethylene fiber of claim 2 having a tensile modulus of at least about 2000 g/denier.

5. The stretched polyethylene fiber of claim 1 or 2 having a main melting temperature at least about 149° C. (measured at 10° C./minute heating rate by differential scanning calorimetry).

6. The stretched polyethylene fiber of claim 1 or 2 or 3 or 4 having a main melting temperature of at least about 149° C. (measured at 10°/minute heating rate by differential scanning calorimetry).

7. The stretched polyethylene fiber of claim 1 or 2 or 3 or 4 being of weight average molecular weight of at least about 1,000,000.

8. The stretched polyethylene fiber of claim 1 or 2 or 3 or 4 being of weight average molecular weight between about 2,000,000 and about 8,000,000.

9. A stretched polyethylene fiber of substantially indefinite length being of weight average molecular weight of at least about 1,000,000 and having a tensile modulus of at least about 1600 g/denier, a main melting temperature of at least about 147° C. (measured at 10° C./minute heating rate by differential scanning calorimetry) and an elongation-to-break of not more than 5%.

10. The stretched polyethylene fiber of claim 9 being of weight average molecular weight between about 2,000,000 and about 8,000,000.

11. The stretched polyethylene fiber of claim 9 or 10 having a main melting temperature of at least about 149° C. (measured at 10° C./minute heating rate by differential scanning calorimetry).

12. The stretched polyethylene fiber of claim 9 or 10 having a tensile modulus of at least about 2000 g/denier.

13. A stretched polypropylene fiber of substantially indefinite length being of weight average molecular weight of at least about 750,000 and having a tenacity of at least about 8 g/denier, a tensile modulus of at least about 160 g/denier and a main melting temperature of at least about 168° C. (measured at 10° C./minute heating rate by differential scanning calorimetry).

14. The stretched polypropylene fiber of claim 13 having a tenacity of at least about 11 g/denier.

15. The stretched polypropylene fiber of claim 13 having a tenacity of at least about 13 g/denier.

16. The stretched polypropylene fiber of claim 13 having a tensile modulus of at least about 200 g/denier.

17. The stretched polypropylene fiber of claim 13 having a tensile modulus of at least about 220 g/denier.

18. The stretched polypropylene fiber of claim 13 or 14 or 15 or 16 or 17 being of weight average molecular weight at least about 1,000,000.

19. The stretched polypropylene fiber of claim 13 or 14 or 15 or 16 or 17 being of weight average molecular weight between about 2,000,000 and about 8,000,000.

* * * * *